US011261863B2

(12) United States Patent
Beisel et al.

(10) Patent No.: US 11,261,863 B2
(45) Date of Patent: Mar. 1, 2022

(54) FLEXIBLE MANIFOLD FOR RECIPROCATING PUMP

(71) Applicant: Halliburton Energy Services, Inc., Houston, TX (US)

(72) Inventors: Joseph A. Beisel, Duncan, OK (US); Justin Lee Hurst, Healdton, OK (US); David Mark Stribling, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 16/594,825

(22) Filed: Oct. 7, 2019

(65) Prior Publication Data

US 2020/0362855 A1 Nov. 19, 2020

Related U.S. Application Data

(63) Continuation-in-part of application No. 16/411,901, filed on May 14, 2019.

(51) Int. Cl.
*F04B 53/16* (2006.01)
*F04B 15/02* (2006.01)
(Continued)

(52) U.S. Cl.
CPC ..... *F04B 53/16* (2013.01); *F04B 1/0408* (2013.01); *F04B 1/0448* (2013.01); *F04B 15/02* (2013.01);
(Continued)

(58) Field of Classification Search
CPC ..... F04B 1/0408; F04B 1/053; F04B 23/06; F04B 49/22; F04B 53/142; F04B 9/10; E21B 43/129
See application file for complete search history.

(56) References Cited

U.S. PATENT DOCUMENTS 1,662,725 A 3/1928 Toney, Jr.
2,567,496 A 9/1951 Pittenger
(Continued)

FOREIGN PATENT DOCUMENTS

CH 257522 A 10/1948
DE 19808724 A1 9/1998
(Continued)

OTHER PUBLICATIONS

Foreign Communication from Related Application—International Search Report and Written Opinion of the International Searching Authority, International Application No. PCT/US2020/022043, dated Jul. 3, 2020, 13 pages.
(Continued)

*Primary Examiner* — Dominick L Plakkoottam
(74) *Attorney, Agent, or Firm* — Conley Rose, P.C.; Rodney B. Carroll

(57) ABSTRACT

A hose for a reciprocating pump, the hose comprising: a first end and a second end separated by a length (L) along a centerline of the hose, wherein the first end reciprocates with a reciprocating element of the reciprocating pump during operation of the reciprocating pump; an inner surface and an outer surface separated by a thickness; and a variable bend radius wherein a bend radius of a first section of the hose is different from a bend radius of at least one second section of the hose, such that, during operation of the reciprocating pump, a stress on the first end of the hose, the second end of the hose, or both the first end of the hose and the second end of the hose is reduced relative to that of a hose that does not contain the variable bend radius.

20 Claims, 13 Drawing Sheets

(51) Int. Cl.

| | |
|---|---|
| ***F04B 1/0408*** | (2020.01) |
| ***F04B 1/0448*** | (2020.01) |
| *F04B 53/14* | (2006.01) |
| *F04B 47/02* | (2006.01) |
| *F04B 53/00* | (2006.01) |
| *F04B 53/12* | (2006.01) |

(52) U.S. Cl.

CPC ..... *F04B 47/02* (2013.01); *F04B 53/006* (2013.01); *F04B 53/12* (2013.01); *F04B 53/143* (2013.01)

(56) References Cited

U.S. PATENT DOCUMENTS

| | | | | |
|---|---|---|---|---|
| 2,673,519 | A | 3/1954 | Halliburton | |
| 2,678,006 | A | 5/1954 | Gray | |
| 3,005,412 | A * | 10/1961 | Camp | F04B 53/142 417/568 |
| 3,229,640 | A | 1/1966 | Williams | |
| 3,299,417 | A | 1/1967 | Sibthorpe | |
| 3,301,197 | A | 1/1967 | Dodson et al. | |
| 3,380,247 | A * | 4/1968 | Colmerauer | F04B 9/10 417/231 |
| 3,459,363 | A | 8/1969 | Miller | |
| 3,516,434 | A | 6/1970 | Noss | |
| 3,664,371 | A | 5/1972 | Schneider | |
| 3,887,305 | A | 6/1975 | Ito | |
| 3,992,505 | A * | 11/1976 | Tally | B29C 33/485 264/295 |
| 4,257,426 | A | 3/1981 | Bailey | |
| 4,341,235 | A | 7/1982 | Nord | |
| 4,478,561 | A | 10/1984 | Elliston | |
| 4,784,588 | A | 11/1988 | Miyashita et al. | |
| 4,850,392 | A | 7/1989 | Crump et al. | |
| 4,939,923 | A | 7/1990 | Sharp | |
| 5,040,408 | A | 8/1991 | Webb | |
| 5,061,159 | A | 10/1991 | Pryor | |
| 5,072,622 | A | 12/1991 | Roach et al. | |
| 5,176,025 | A | 1/1993 | Butts | |
| 5,297,896 | A | 3/1994 | Webb | |
| 5,343,738 | A | 9/1994 | Skaggs | |
| 5,403,168 | A | 4/1995 | Evenson | |
| 5,720,325 | A | 2/1998 | Grantham | |
| 5,775,842 | A | 7/1998 | Osborne | |
| 5,924,853 | A | 7/1999 | Pacht | |
| 6,032,699 | A | 3/2000 | Cochran et al. | |
| 6,082,392 | A | 7/2000 | Watkins, Jr. | |
| 6,164,188 | A | 12/2000 | Miser | |
| 6,270,327 | B1 | 8/2001 | Wolz et al. | |
| 6,342,272 | B1 | 1/2002 | Halliwell | |
| 6,607,010 | B1 * | 8/2003 | Kashy | D04C 1/02 138/121 |
| 6,935,161 | B2 | 8/2005 | Hutchinson | |
| 7,798,165 | B2 | 9/2010 | McClung, Jr. | |
| 8,234,911 | B2 | 8/2012 | Jax | |
| 8,360,751 | B2 * | 1/2013 | Duncan | F04B 49/22 417/402 |
| 8,366,408 | B2 | 2/2013 | Wago et al. | |
| 8,418,363 | B2 | 4/2013 | Patel | |
| 8,506,262 | B2 | 8/2013 | Leugemors et al. | |
| 8,550,102 | B2 | 10/2013 | Small | |
| 8,590,614 | B2 | 11/2013 | Surjaatmadja et al. | |
| 9,499,895 | B2 | 11/2016 | Langan et al. | |
| 9,528,508 | B2 | 12/2016 | Thomeer et al. | |
| 9,617,654 | B2 | 4/2017 | Rajagopalan et al. | |
| 9,625,071 | B2 * | 4/2017 | Melo | F16L 33/2071 |
| 9,822,894 | B2 | 11/2017 | Bayyouk et al. | |
| 9,969,036 | B2 * | 5/2018 | Hariram | F16L 11/125 |
| 2007/0044848 | A1 | 3/2007 | Norman | |
| 2007/0267076 | A1 | 11/2007 | Strauss et al. | |
| 2008/0011057 | A1 | 1/2008 | Spaolonzi et al. | |
| 2009/0041588 | A1 | 2/2009 | Hunter et al. | |
| 2009/0041596 | A1 | 2/2009 | Ponomarev et al. | |
| 2009/0159133 | A1 | 6/2009 | Popke et al. | |
| 2009/0194174 | A1 | 8/2009 | Morgan et al. | |
| 2009/0246051 | A1 | 10/2009 | Kim | |
| 2009/0278069 | A1 | 11/2009 | Blanco et al. | |
| 2010/0098568 | A1 | 4/2010 | Marica | |
| 2010/0126250 | A1 | 5/2010 | Jax | |
| 2011/0180740 | A1 | 7/2011 | Marica | |
| 2012/0148431 | A1 | 6/2012 | Gabriel | |
| 2012/0223267 | A1 | 9/2012 | Marica | |
| 2012/0279721 | A1 * | 11/2012 | Surjaatmadja | F04B 53/10 166/369 |
| 2012/0312402 | A1 | 12/2012 | Tyler | |
| 2013/0061942 | A1 | 3/2013 | Hulsey | |
| 2013/0319220 | A1 | 12/2013 | Lahuraka et al. | |
| 2014/0064996 | A1 | 3/2014 | Arima | |
| 2014/0127036 | A1 | 5/2014 | Buckley et al. | |
| 2014/0127058 | A1 | 5/2014 | Buckley et al. | |
| 2014/0127062 | A1 | 5/2014 | Buckley et al. | |
| 2014/0150889 | A1 | 6/2014 | Ragner | |
| 2014/0261790 | A1 | 9/2014 | Marica | |
| 2014/0312257 | A1 | 10/2014 | Marica | |
| 2014/0322050 | A1 | 10/2014 | Marette et al. | |
| 2014/0328701 | A1 | 11/2014 | Nathan | |
| 2014/0348677 | A1 | 11/2014 | Moeller et al. | |
| 2015/0132157 | A1 | 5/2015 | Whaley et al. | |
| 2016/0131131 | A1 | 5/2016 | Weaver et al. | |
| 2016/0131264 | A1 | 5/2016 | Bregazzi et al. | |
| 2016/0215588 | A1 | 7/2016 | Belshan et al. | |
| 2016/0281699 | A1 | 9/2016 | Gnessin et al. | |
| 2016/0319805 | A1 | 11/2016 | Dille | |
| 2018/0058431 | A1 | 3/2018 | Blume | |
| 2018/0058444 | A1 | 3/2018 | Blume | |
| 2018/0298894 | A1 | 10/2018 | Wagner et al. | |
| 2019/0120389 | A1 | 4/2019 | Foster et al. | |
| 2019/0145391 | A1 | 5/2019 | Davids | |
| 2019/0226475 | A1 | 7/2019 | Stark et al. | |
| 2020/0347706 | A1 | 11/2020 | Nowell et al. | |

FOREIGN PATENT DOCUMENTS

| | | | |
|---|---|---|---|
| EP | 0580196 | A1 | 1/1994 |
| EP | 1103722 | A2 | 5/2001 |
| EP | 2383470 | A1 | 11/2011 |
| GB | 120622 | A | 11/1918 |
| GB | 450645 | A | 7/1936 |
| GB | 672173 | A | 5/1952 |
| GB | 1226014 | A | 3/1971 |
| GB | 1262826 | A | 2/1972 |
| JP | 63001012 | Y2 | 1/1988 |
| JP | 2002037217 | A | 2/2002 |
| JP | 2004257283 | A | 9/2004 |
| JP | 4121804 | B2 | 7/2008 |
| JP | 2009131747 | A | 6/2009 |
| JP | 5107651 | B2 | 12/2012 |
| JP | 2015078838 | A | 4/2015 |
| JP | 2020040010 | A | 3/2020 |

OTHER PUBLICATIONS

Filing receipt and specification for patent application entitled "Pump Fluid End with Easy Access Suction Valve," by Justin L. Hurst, et al., filed May 14, 2019 as U.S. Appl. No. 16/411,891.

Filing receipt and specification for patent application entitled "Easy Change Pump Plunger," by Justin L. Hurst, et al., filed May 14, 2019 as U.S. Appl. No. 16/411,894.

Filing receipt and specification for patent application entitled "Pump Valve Seat with Supplemental Retention," by Justin L. Hurst, et al., filed May 14, 2019 as U.S. Appl. No. 16/411,898.

Filing receipt and specification for patent application entitled "Flexible Manifold for Reciprocating Pump," by Joseph A. Beisel, et al., filed May 14, 2019 as U.S. Appl. No. 16/411,901.

Filing receipt and specification for patent application entitled "Valve Assembly for a Fluid End with Limited Access," by Justin L. Hurst, et al., filed May 14, 2019 as U.S. Appl. No. 16/411,910.

Filing receipt and specification for patent application entitled "Pump Plunger with Wrench Features," by Justin L. Hurst, et al., filed May 14, 2019 as U.S. Appl. No. 16/411,905.

(56) References Cited

OTHER PUBLICATIONS

Filing receipt and specification for patent application entitled "Pump Fluid End with Suction Valve Closure Assist," by Justin L. Hurst, et al., filed Jun. 10, 2019 as U.S. Appl. No. 16/436,312.
Filing receipt and specification for patent application entitled "Multi-Material Frac Valve Poppet," by Jim B. Surjaatmadja, et al., filed Jun. 10, 2019 as U.S. Appl. No. 16/436,356.
Filing receipt and specification for patent application entitled "Multi-Layer Coating for Plunger and/or Packing Sleeve," by Justin L. Hurst, et al., filed Jun. 10, 2019 as U.S. Appl. No. 16/436,389.
Acknowledgement receipt and specification for International application entitled "Multi-Layer Coating for Plunger and/or Packing Sleeve," by Justin L. Hurst, et al., filed Jun. 12, 2019 as International application No. PCT/US2019/036785.
Filing receipt and specification for patent application entitled "Pump Fluid End with Positional Indifference for Maintenance," by Justin L. Hurst, et al., filed May 14, 2019 as U.S. Appl. No. 16/411,911.
Filing receipt and specification for patent application entitled, "Oil Field Pumps with Reduced Maintenance," by Jim B. Surjaatmadja, et al., filed Jul. 26, 2019 as U.S. Appl. No. 16/522,860.
Acknowledgement receipt and specification for International application entitled "Oil Field Pumps with Reduced Maintenance," by Jim B. Surjaatmadja, et al., filed Jul. 30, 2019 as International application No. PCT/US2019/044191.
Filing receipt and specification for patent application entitled, "Fail Safe Suction Hose for Significantly Moving Suction Port," by Jim B. Surjaatmadja, et al., filed Jul. 26, 2019 as U.S. Appl. No. 16/522,874.
Acknowledgement receipt and specification for International application entitled "Fail Safe Suction Hose for Significantly Moving Suction Port," by Jim B. Surjaatmadja, et al., filed Jul. 30, 2019 as International application No. PCT/US2019/044194.
Office Action (Restriction Requirement) dated Aug. 28, 2019, 2019 (7 pages), U.S. Appl. No. 16/522,874, filed Jul. 26, 2019.
Office Action (Restriction Requirement) dated Aug. 30, 2019, 2019 (5 pages), U.S. Appl. No. 16/436,356, filed Jun. 10, 2019.
Foreign Communication from Related Application—International Search Report and Written Opinion of the International Searching Authority, International Application No. PCT/US2019/044194, dated Apr. 23, 2020, 12 pages.
Notice of Allowance and Fee(s) Due dated Jan. 28, 2020 (14 pages), U.S. Appl. No. 16/522,874, filed Jul. 26, 2019.
Kiani, Mahdi et al., "Numerical Modeling and Analytical Investigation of Autofrettage Process on the Fluid End Module of Fracture Pumps," Journal of Pressure Vessel Technology, Aug. 2018, pp. 0414031-0414037, vol. 140, ASME.
"Pump Catalog," Cat Pumps, Inc., 2014, 24 pages.
Furuta, Katsunori et al., "Study of the In-Line Pump System for Diesel Engines to Meet Future Emission Regulations," SAE International Congress and Exposition, Feb. 1998, pp. 125-136, Society of Automotive Engineers, Inc.
"550 Series: High Pressure, High Flow Water Jetting," Gardner Denver Water Jetting Systems, Inc., 2009, 4 pages.
Houghton, J.E. et al., "Improved Pump Run Time Using Snow Auto-Rotating Plunger (SARP) Pump," SPE Western Regional Meeting, May 1998, SPE46217, 6 pages, Society of Petroleum Engineers, Inc.
"Improved Double Acting Pump," Scientific American, 1867, pp. 248, vol. 17, No. 16, American Periodicals.
Langewis, Jr., C. et al., "Practical Hydraulics of Positive Displacement Pumps for High-Pressure Waterflood Installations," Journal of Petroleum Technology, Feb. 1971, pp. 173-179, SPE-AIME/Continental Oil Co.
Petzold, Martin et al., "Visualization and Analysis of the Multiphase Flow in an Electromagnetically Driven Dosing Pump," ASME/BATH Symposium on Fluid Power & Motion Control, Oct. 2013, FPMC2013-4433, 6 pages, ASME.
Romer, M. C. et al., "Field Trial of a Novel Self-Reciprocating Hydraulic Pump for Deliquification," SPE Production & Operations, 2017, 12 pages, Society of Petroleum Engineers.
Office Action (Restriction Requirement) dated Aug. 28, 2019, (7 pages), U.S. Appl. No. 16/522,874, filed Jul. 26, 2019.
Office Action (Restriction Requirement) dated Aug. 30, 2019, (5 pages), U.S. Appl. No. 16/436,356, filed Jun. 10, 2019.
Office Action dated Oct. 22, 2019 (27 pages), U.S. Appl. No. 16/522,874, filed Jul. 26, 2019.
Office Action dated Oct. 31, 2019 (21 pages), U.S. Appl. No. 16/436,356, filed Jun. 10, 2019.
Scully Intellicheck2, Complete Overfill Prevention and Retained Product Monitoring System, 67293 Rev B, Oct. 2013, 2 pages.
Scully Intellicheck2, Complete Overfill Prevention and Retained Product Monitoring System, 67293 Rev B, May 2014, 2 pages.
Scully Intellicheck3, Complete Overfill Prevention and Retained Product Monitoring System, XXXXX Rev A, Jun. 2016, 2 pages.

* cited by examiner

FLEXIBLE MANIFOLD FOR RECIPROCATING PUMP

CROSS-REFERENCE TO RELATED APPLICATIONS

The present application is a continuation-in-part of U.S. patent application Ser. No. 16/411,901 filed May 14, 2019 by Joseph A Beisel, et al., and entitled "Flexible Manifold for Reciprocating Pump", which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present disclosure relates generally to a method and apparatus for supplying pressurized fluids. More particularly, the present disclosure relates to methods and reciprocating devices for pumping fluids into a wellbore. Still more specifically, this disclosure provides a hose for a reciprocating pump.

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. Design considerations may include pump fluid end lifetime and ease of access to pump fluid end components, as reciprocating pumps used in wellbore operations, for example, often encounter high cyclical pressures and various other conditions that can render pump components susceptible to wear and result in a need for servicing and maintenance of the pump.

Accordingly, it is desirable to provide a pump fluid end that enables longer lifetime, reduced cost, and/or easier maintenance of the pump fluid end. Desirably, such a pump fluid end facilitates access to components therein, such as a primary reciprocating element packing, components of a suction valve assembly, components of a discharge valve assembly, or a combination thereof.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a reciprocating apparatus for pumping pressurized fluid. In embodiments, the reciprocating apparatus comprises a pump comprising a pump fluid end having a reciprocating element bore, a reciprocating element, a movable manifold, and a power end operatively connected to the reciprocating element and operable to reciprocate the reciprocating element in the reciprocating element bore of the pump fluid end. In embodiments, the reciprocating element has a front end opposite a fluid intake end and comprises a peripheral wall defining a hollow body, and the movable manifold comprises a reciprocating element end and a fluid intake end, and the reciprocating element end of the movable manifold is fluidly connected with the fluid intake end of the reciprocating element, whereby the reciprocating element end of the movable manifold can move in a same axial direction as the reciprocating element during reciprocation of the reciprocating element in alternating directions along a path within the reciprocating element bore of the pump fluid end, and the fluid intake end of the movable manifold is configured for fluid coupling with a stationary fluid manifold such that fluid can be introduced into the movable manifold via the stationary fluid manifold and the fluid intake end of the movable manifold. In embodiments, the reciprocating apparatus is a high-pressure pump configured to operate at a pressure greater than or equal to about 3,000 psi and/or in a well servicing operation and environment.

Figure 1:
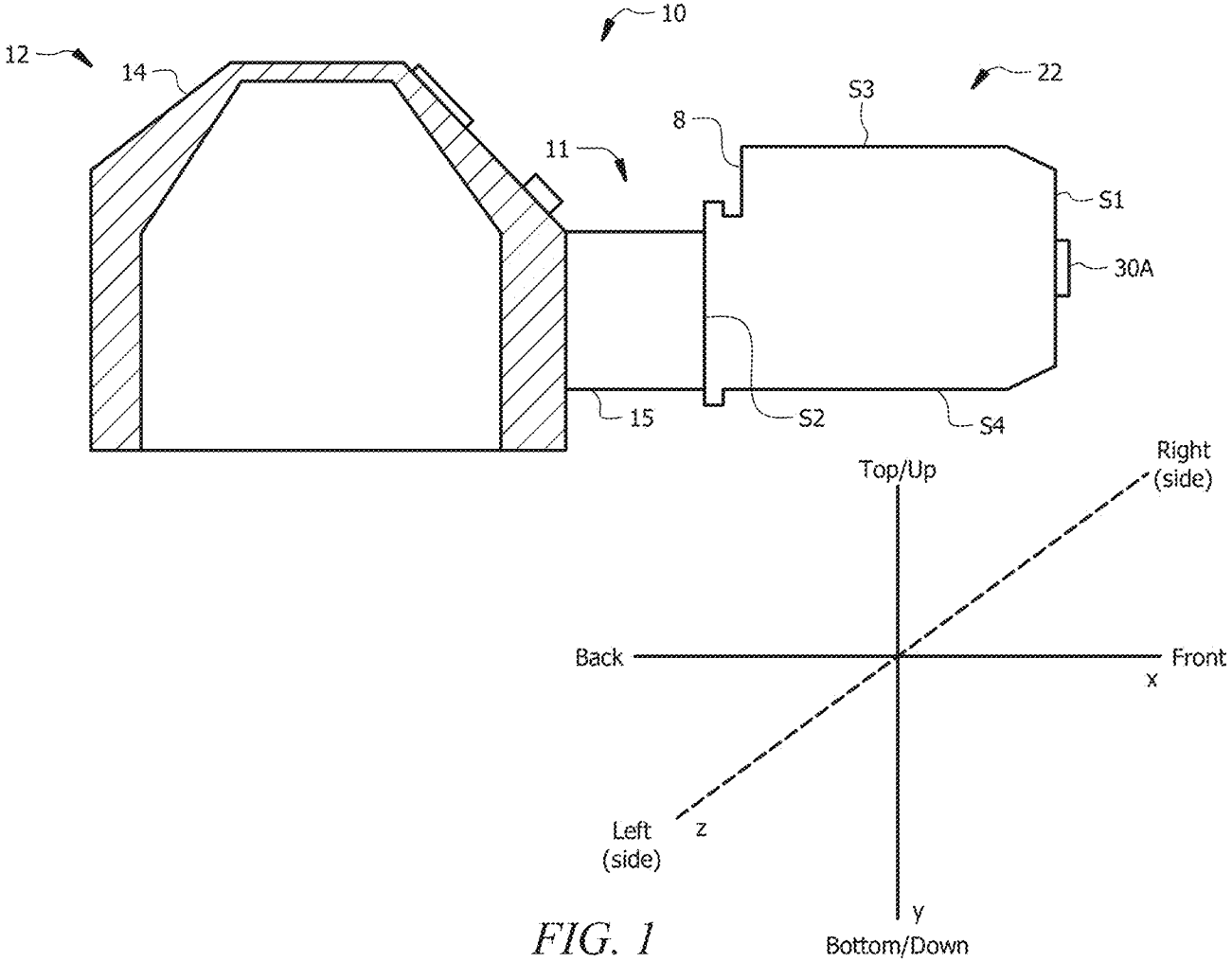
FIG. 1 is an elevational view of a reciprocating pump, according to embodiments of this disclosure.

A reciprocating apparatus of this disclosure may comprise any suitable pump operable to pump fluid. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end. FIG. 1 is an elevational view (e.g., side view) of a pump 10 (e.g., a reciprocating pump) according to an exemplary embodiment, the reciprocating pump comprising a pump power end 12, a pump fluid end 22, and an integration section 11. As illustrated in FIG. 1, pump fluid end has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the x-axis is along a plane perpendicular to the plane of the x-axis and the y-axis. Accordingly, toward the top of pump fluid end 22 (and pump 10) is along the y-axis toward top S3, toward the bottom of pump fluid end 22 (and pump 10) is along the y-axis toward bottom S4, toward the front of pump fluid end 22 (and pump 10) is along the x-axis toward front S1, and toward the back of pump fluid end 22 (and pump 10) is along the x-axis away from front S1.

Figure 2A:
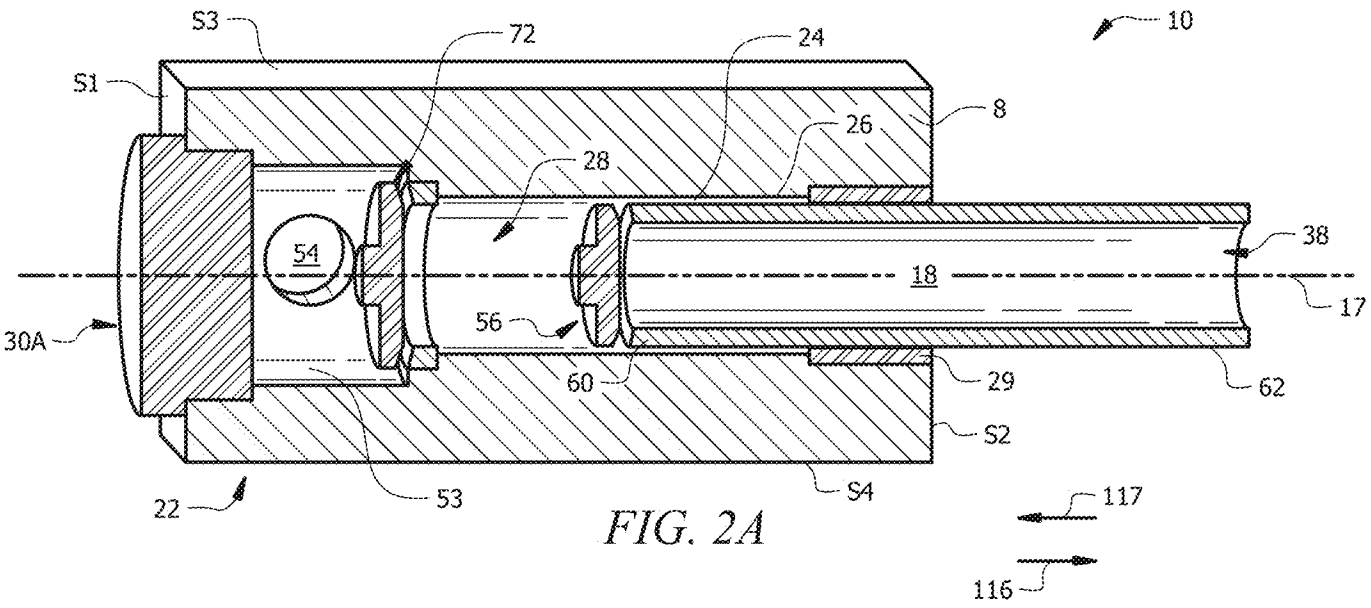
FIG. 2A is a cut-away illustration of an exemplary reciprocating pump comprising a concentric bore pump fluid end, according to embodiments of the present disclosure.
Figure 2B:
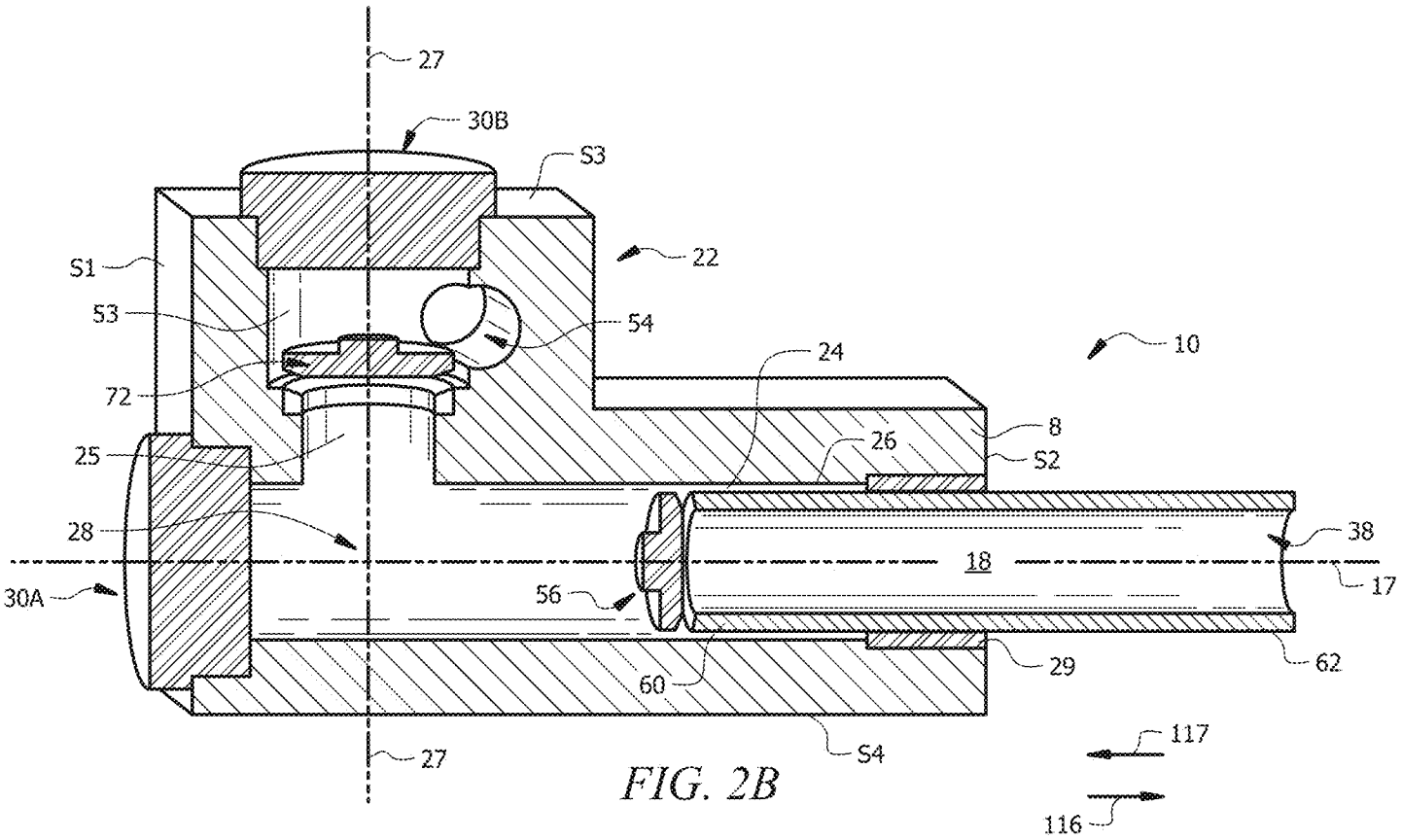
FIG. 2B is a cut-away illustration of an exemplary reciprocating pump comprising a tee-bore ("T-bore") pump fluid end, according to embodiments of the present disclosure.

The pump fluid end 22 is integrated with the pump power end 12 via the integration section 11, such that pump power end 12 is operable to reciprocate the reciprocating element 18 within a reciprocating element bore 24 (FIG. 2A/FIG. 2B) of the pump fluid end 22. The reciprocating element bore 24 is at least partially defined by a cylinder wall 26. As described further hereinbelow with reference to FIG. 2A, pump fluid end 22 of this disclosure can be an in-line or "concentric" bore pump fluid end. In alternative embodiments, described further hereinbelow with reference to FIG. 2B, pump fluid end 22 is a "cross-bore" pump fluid end 22, which, as utilized herein, can include "T-bore" pump fluid ends, "X-bore" (e.g., cross shaped bore) pump fluid ends, or "Y-bore" pump fluid ends. FIG. 2A is a schematic showing a concentric bore pump fluid end 22 engaged with a reciprocating element 18. FIG. 2B is a schematic showing a T-bore pump fluid end 22 engaged with a reciprocating element 18. As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 3:
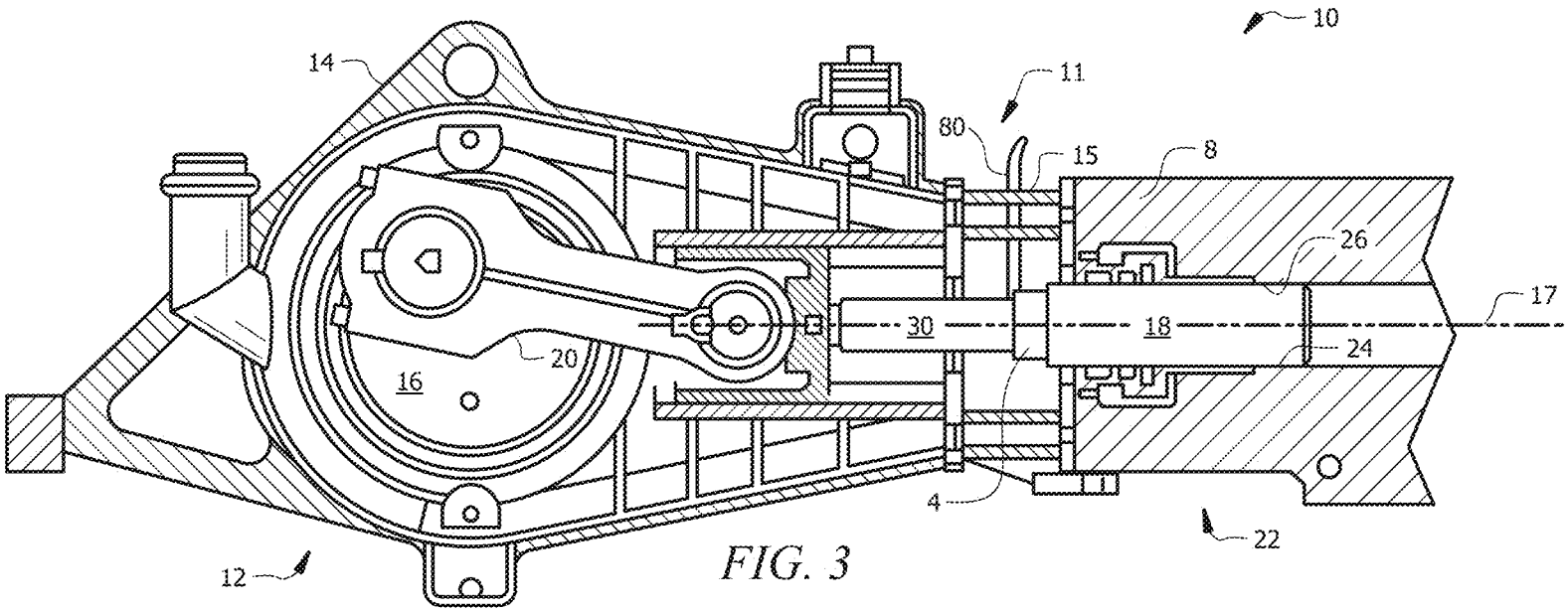
FIG. 3 is cut-away illustration of a pump power end of a pump, according to embodiments of the present disclosure.

Those versed in the art will understand that the pump power end 12 may include various components commonly employed in pumps. Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 3 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm 20 and pushrod 30. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", although not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIG. 2A and FIG. 2B. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes (also referred to as discharge strokes and correlating to movement in a positive direction parallel to the x-axis of FIG. 1) and return strokes (also referred to as suction strokes and correlating to movement in a negative direction parallel to the x-axis of FIG. 1), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. When discharge valve assembly 72 is in a closed configuration (e.g., under the influence of a closing mechanism, such as a spring, the high pressure in a discharge pipe or manifold containing discharge outlet 54) prevents fluid flow into discharge chamber 53 and causes pressure in the pump chamber 28 to accumulate upon stroking of the reciprocating element 18. When the reciprocating element 18 begins the forward stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body and a valve seat thereof) and a configuration in which fluid cannot flow through the valve assembly (e.g., cannot pass between a valve body and a valve seat thereof). As the reciprocating element 18 extends forward, fluid within the pump chamber 28 is discharged through the discharge outlet 54.

During a return stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiment of FIG. 2A, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration of FIG. 2A, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). With reference to the embodiment of FIG. 2B, which is a schematic showing a T-bore pump fluid end 22 engaged with a reciprocating element 18, T-bore pump fluid end 22 comprises a T-bore fluid end body 8, a T-shaped pump chamber 28, a suction valve assembly 56, and a discharge valve assembly 72. In this T-bore configuration of FIG. 2B, suction valve assembly 56 is coupled with front end 60 of reciprocating element 18 and discharge valve assembly 72 is positioned in bore 25 that makes a tee with reciprocating element bore 24, i.e., central axis 17 of reciprocating element bore 24 is also the central axis of suction pump assembly 56 and perpendicular to a central axis 27 of discharge valve assembly 72).

Suction valve assembly 56 and discharge valve assembly 72 are operable to direct fluid flow within the pump 10. In pump fluid end 22 designs of this disclosure, fluid flows within a hollow reciprocating element (e.g., a hollow plunger) 18 via fluid inlet 38 located toward tail end 62 of reciprocating element 18. The reciprocating element bore 24 of such a fluid end design can be defined by a high pressure cylinder 26 providing a high pressure chamber. (As utilized here, "high pressure" indicates possible subjection to high pressure during discharge.) When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a pump fluid end 22 design of this disclosure, the fluid inlet 38 is configured to introduce fluid into pump chamber 28 via a reciprocating element 18 that is hollow. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. With reference to the concentric fluid end body 8 embodiment of FIG. 2A, a front access port 30A can be located on a front S1 of the pump fluid end 22 opposite a back S2 of the pump fluid end 22, wherein the back S2 of the pump fluid end is proximal the pump power end 12, upon integration therewith via integration section 11. With reference to the T-bore fluid end body 8 embodiment of FIG. 2B, a front access port 30A can be located on a front S1 of the pump fluid end 22 opposite a back S2 of the pump fluid end 22, wherein the back S2 of the pump fluid end is proximal the pump power end 12, upon integration therewith via integration section 11, and a top access port 30B can be located on a top S3 of the pump fluid end 22 opposite a bottom S4 of pump fluid end 22. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port. In embodiments, the at least one access port is located on a side of the discharge valve assembly 72 opposite the suction valve assembly 56. For example, in the concentric bore pump fluid end 22 embodiment of FIG. 2A, front access port 30A is located on a side (e.g., front side) of discharge valve assembly 72 opposite suction valve assembly 56. In the T-bore pump fluid end 22 embodiment of FIG. 2B, front access port 30A is located on top S3 of pump fluid end 22.

In embodiments, one or more seals 29 (e.g., "o-ring" seals, packing seals, or the like), also referred to herein as 'primary' reciprocating element packing 29 may be arranged around the reciprocating element 18 to provide sealing between the outer walls of the reciprocating element 18 and the inner walls 26 defining at least a portion of the reciprocating element bore 24. In fluid end designs such as described herein operated with a hollow reciprocating element 18, a second set of seals (also referred to herein as 'secondary' reciprocating element packing; not shown in the Figures) is conventionally arranged around the reciprocating element 18 to provide sealing between the outer walls of the reciprocating element 18 and the inner walls of a low-pressure cylinder that defines a low pressure fluid chamber (e.g., wherein the secondary packing is farther back along the x-axis and delineates a back end of a low pressure chamber that extends from the primary packing 29 to the secondary packing). According to this disclosure, only a primary reciprocating element packing is utilized, as fluid enters tail end 62 of reciprocating element 18 without first contacting an outer peripheral wall thereof (i.e., no secondary reciprocating element packing is needed/utilized, because no low pressure chamber external to reciprocating element 18 is utilized). Skilled artisans will recognize that the seals of the primary packing may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24. In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26. In embodiments, one or more additional components or mechanical linkages 4 (FIG. 4; e.g., clamps, adapters, extensions, etc.) may be used to couple the reciprocating element 18 to the pump power end 12 (e.g., to a crank arm 20 or pushrod 30).

According to this disclosure, reciprocating element 18 employed in a concentric bore pump fluid end 22 embodiment (such as depicted in FIG. 2A) or a T-bore pump fluid end 22 (such as depicted in FIG. 2B) comprises a peripheral wall 84 defining a hollow body. In embodiments, a portion of the peripheral wall 84 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end, when assembled, may be substantially solid and/or impermeable (e.g., a plunger having both a hollow portion and a solid portion).

The reciprocating element 18 comprises a front or free end 60. In embodiments, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back or tail end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within reciprocating element bore 24 and at least partially within reciprocating element 18 in concentric bore pump fluid end 22 designs such as FIG. 2A or T-bore pump fluid end 22 designs such as FIG. 2B, such that a suction valve body of the suction valve assembly 56 moves away from a suction valve seat within the a suction valve seat housing of reciprocating element 18 when the suction valve assembly 56 is in an open configuration and toward the suction valve seat when the suction valve assembly 56 is in a closed configuration.

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed proximal the front S1 of bore 24 (e.g., at least partially within discharge chamber 53 and/or pump chamber 28) of the pump fluid end 22, such that a discharge valve body of the discharge valve assembly 72 moves toward the discharge chamber 53 when the discharge valve assembly 72 is in an open configuration and away from the discharge chamber 53 when the discharge valve assembly 72 is in a closed configuration. In addition, in concentric bore pump fluid end 22 configurations such as FIG. 2A, the discharge valve assembly 72 may be co-axially aligned with the suction valve assembly 56 (e.g., along central axis 17), and the suction valve assembly 56 and the discharge valve assembly 72 may be coaxially aligned with the reciprocating element 18 (e.g., along central axis 17). In alternative embodiments, such as the T-bore pump fluid end 22 embodiment of FIG. 2B, discharge valve assembly 72 can be positioned within T-bore 25, at least partially within discharge chamber 53 and/or pump chamber 28, and have a central axis coincident (e.g., coaxial) with central axis 27 of T-bore 25.

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, poppets, etc.) and/or components may be employed suitable means for retaining the components of the suction valve assembly 56 and the components of the discharge valve assembly 72 within the pump fluid end 22 may be employed.

The pump 10 may comprise and/or be coupled (as detailed further hereinbelow) to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q-10™ Quintuplex Pump or an HT-400™ Triplex Pump, produced by Halliburton Energy Services, Inc.

In embodiments, the pump fluid end 22 may comprise an external or stationary fluid manifold (e.g., a suction header), as described in more detail hereinbelow (stationary fluid manifold 83 with reference to FIGS. 4-7B) for feeding fluid to the multiple reciprocating assemblies via any suitable inlet(s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms 20, connecting rods, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the multiple reciprocating elements may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIG. 2A and FIG. 2B) forward in its cylinder. A top dead center position corresponds to the position of a fully extended reciprocating element at zero velocity, e.g., just prior to a reciprocating element moving backward (i.e., in a direction indicated by arrow 116 in FIG. 2A and FIG. 2B) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

With reference back to FIG. 3, according to this disclosure, and as described further hereinbelow, a pump 10 comprises: a pump fluid end 22 (e.g., a concentric bore pump fluid end 22 such as depicted in FIG. 2A or a cross-bore pump fluid end such as T-bore pump fluid end 22 of FIG. 2B) and a power end 12, operatively connected via an integration section 11, within which a movable manifold 80 is located. Movable manifold 80 is operable to provide fluid to an interior of reciprocating element 18. A pump 10 of this disclosure comprises an integration section 11, integrated between pump fluid end 22 and pump power end 12, and within which movable manifold 80 can reciprocate in conjunction with reciprocation of reciprocating element 18, as described further hereinbelow.

As described above, the pump power end 12 is coupled to a pump fluid end 22 having a reciprocating element bore 24, within which a reciprocatable reciprocating element 18 reciprocates due to the action of the power end 12, which is operatively connected to the reciprocating element 18 and operable to reciprocate the reciprocating element 18 in the reciprocating element bore 24 of the pump fluid end 22. The reciprocating element 18 has a front end 60 opposite a fluid intake or tail end 62 and comprises a peripheral wall 84 defining a hollow (e.g., cylindrical) body. Reciprocating element or plunger 18 can be any shape (e.g., cylindrical) having a constant external cross section as it moves through the reciprocating element packing 29. Reciprocating element or plunger packing can be stationary or move with the plunger/piston 18 during operation of reciprocating pump 10.

Integration section 11 comprises a housing 15 designed such that the reciprocating element end 81 of movable manifold 80 can reciprocate simultaneously with reciprocating element 18. Via movable manifold 80, fluid can be fed to the tail end 62 of a hollow body reciprocating element 18 from a stationary fluid manifold 83 (also referred to as a stationary suction manifold 83).

A movable manifold 80 of this disclosure comprises a reciprocating element end 81 and a fluid intake end 82. The reciprocating element end 81 of the movable manifold 80 is fluidly connected with the fluid intake end 62 of the reciprocating element 18 (comprising fluid inlet 38), whereby the reciprocating element end 81 of the movable manifold 80 moves in a same axial direction (e.g., in a direction indicated by arrow 116 or 117) as the reciprocating element 18 during reciprocation of the reciprocating element 18 in alternating directions along a path within the reciprocating element bore 24 of the fluid end 22. The fluid intake end 82 of the movable manifold 80 is configured for fluid coupling with a stationary fluid manifold 83 such that fluid can be introduced into the movable manifold 80 via the stationary fluid manifold 83 and the fluid intake end 82 of the movable manifold 80. In embodiments, the stationary fluid manifold 83 and movable manifold 80 are designed and positioned (e.g., above, below, or to the side of pump power end 12) such that, during operation of pump 10, movable manifold 80 does not contact pump power end 12. Exemplary movable manifolds 80 will now be described with reference to FIGS. 4, 5A-5B, 6A-6B, and 7A-7B.

Figure 4A:
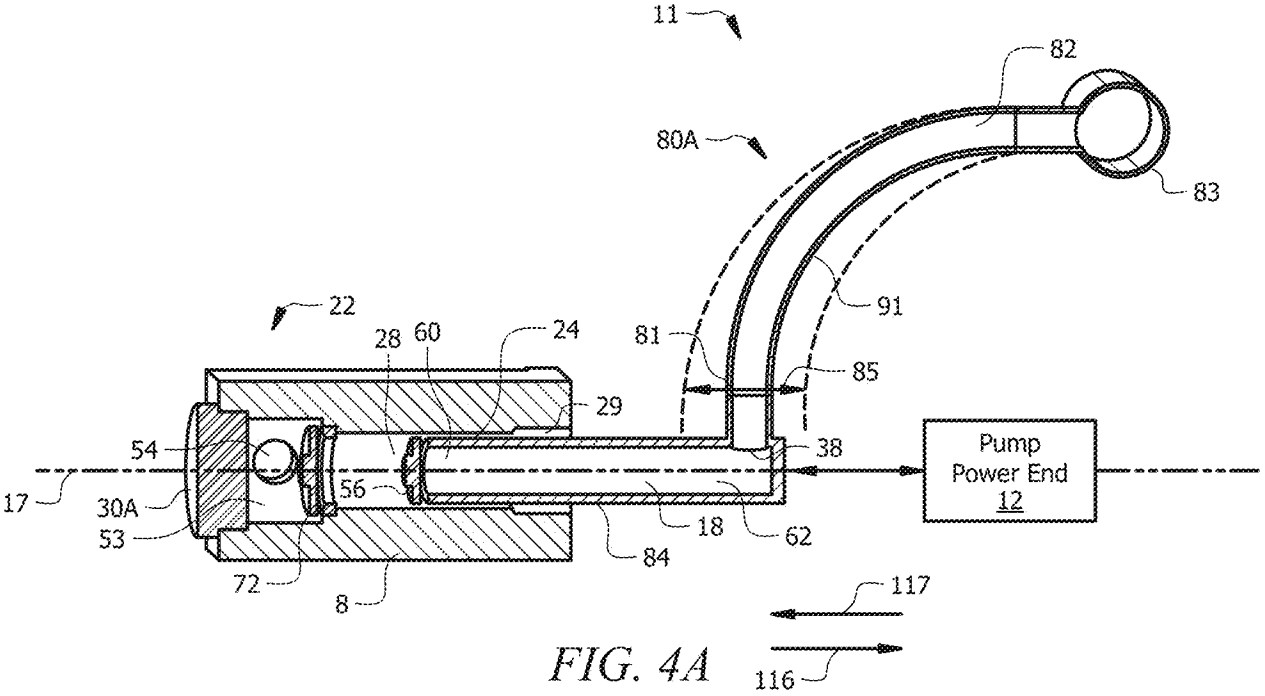
FIG. 4A is a schematic of an integration section of a pump comprising a flexible hose type movable manifold, according to embodiments of the present disclosure.

In embodiments, movable manifold 80 is a flexible hose type movable manifold. FIG. 4A is a schematic of an integration section 11 of a pump 10 comprising a flexible hose type movable manifold 80A, according to embodiments of the present disclosure. In the embodiment of FIG. 4A, movable manifold 80 (FIG. 3) comprises a flexible hose type movable manifold 80A. The flexible hose type movable manifold 80A provides that, when the fluid intake end 81 thereof is connected with the stationary fluid manifold 83, the flexible hose 91 of flexible hose movable manifold 80A maintains a curvature between the fluid intake end 82 thereof and the reciprocating element end 81 thereof during the reciprocation of the reciprocating element 18 within reciprocating element bore 24. As depicted in FIG. 4A, a flexible hose 91 range of motion 85 along central axis 17 is provided by the flexible hose 91 of flexible hose manifold 80A allows movement of the reciprocating element end 81 of flexible hose movable manifold 80A, while fluid intake end 82 of flexible hose movable manifold 80 is fluidly coupled with stationary fluid manifold 83 and remains stationary with reference to central axis 17. As will be apparent to those of skill in the art and with the help of this disclosure, by selecting an appropriate radius of flexible hose 91, bucking, kinking, and pinching of flexible hose 91 can be avoided, and flexible hose 91 can maintain a controlled smooth arc during pumping with a pump 10 comprising flexible hose type movable manifold 80A. In embodiments, an additional support (e.g., a surface upon which the flexible hose can rest such as a "gooseneck" or other curved support member) can be utilized along a length of flexible hose 91 to facilitate appropriate movement thereof during pumping operations and/or limit motion, such as by enforcing a minimum bend radius and/or distributing flexure over a longer length, etc.

Description of for a hose for a reciprocating pump, according to this disclosure, will now be made with reference to FIG. 4B, which is a schematic of flexible hose type movable manifold 80A' comprising a flexible hose 91A, according to embodiments of the present disclosure. As noted herein, movable manifold 80A' is designed to accommodate the motion (e.g., back and forth in the directions indicated by 17A of FIG. 4B) of the reciprocating element 18 when reciprocating pump 10 is in operation, by allowing movement of reciprocating element end 81 of movable manifold 80 with reciprocating element 18 while fluid intake end 82 of movable manifold 80 is stationary where attached to stationary manifold 83. FIG. 4C is a side cross-section view of the hose of FIG. 4B. Flexible hose 91A comprises a first extent E1 of the flexible hose 91A and a second extent E2 of the flexible hose 91A separated by a length L along a centerline C of the hose 91A, wherein the first extent E1 of the hose 91A reciprocates with a reciprocating element 18 of the reciprocating pump 10 during operation of the reciprocating pump 10. That is, first extent E1 (FIG. 4C) of reciprocating element end 81A of flexible hose 91A is separated from second extent E2 (FIG. 4C) of fluid intake end 81A of flexible hose 91A along centerline C of flexible hose 91A. The reciprocating element end 81 of flexible hose type movable manifold 80A' comprises or is coupled with reciprocating element end 81A of flexible hose 91A, while fluid intake end 82 of flexible hose type movable manifold 80A' comprises or is coupled with fluid intake end 82A of flexible hose 91A. When installed in a pump 10 of this disclosure, first extent E1 of fluid intake end 82A of flexible hose 91A is fluidly connected with the fluid intake end 62 of the reciprocating element 18, whereby the first extent E1 of flexible hose 91A moves in a same axial direction as the reciprocating element 18 during reciprocation of the reciprocating element 18 in alternating directions along a path within the reciprocating element bore 24 of the bore pump fluid end 22, and second extent E2 of flexible hose 91A is configured for fluid coupling with stationary fluid manifold 83 such that fluid can be introduced into flexible hose 91A of flexible hose type movable manifold 80A' via the stationary fluid manifold 82 and the second extent E2 of flexible hose 91A.

Figure 4B:
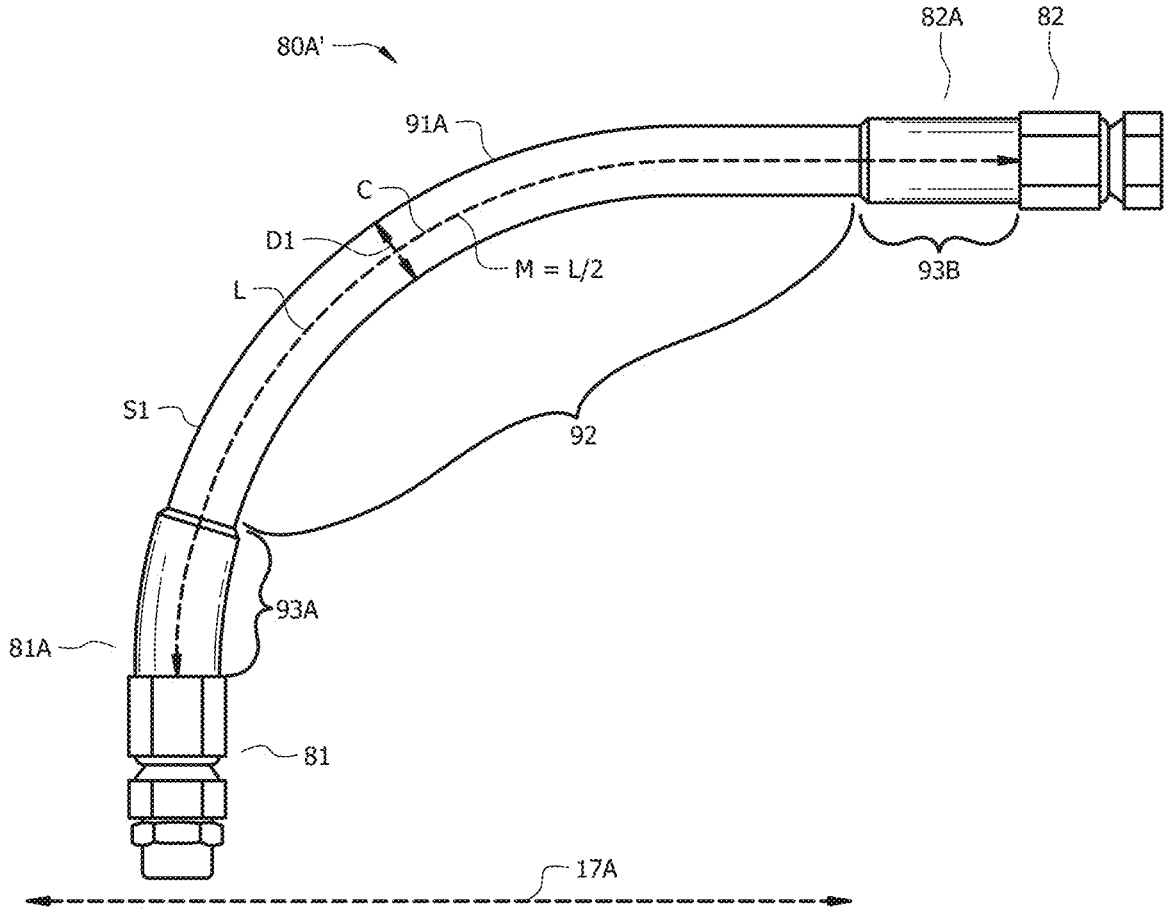
FIG. 4B is a schematic of a hose for a flexible hose type movable manifold, according to embodiments of the present disclosure.
Figure 4C:
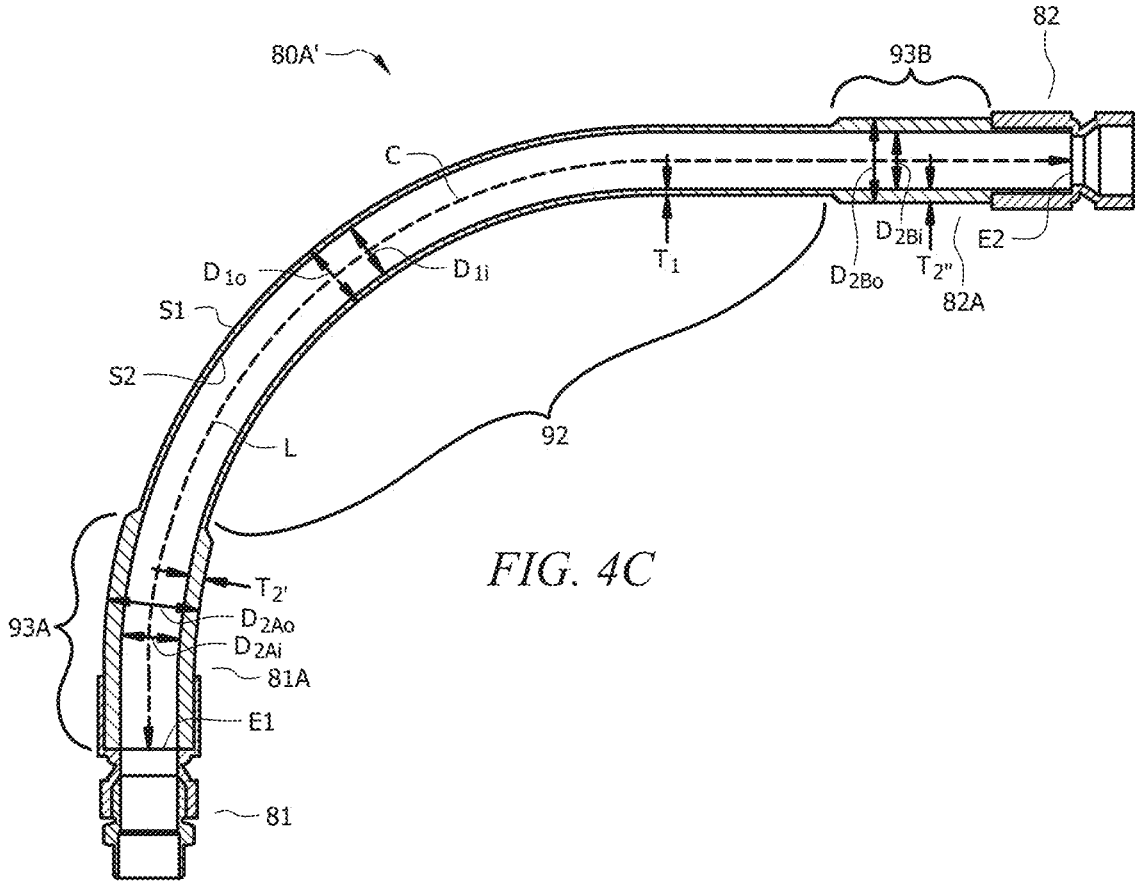
FIG. 4C is a side cross-section view of the hose of FIG. 4B.
Figure 4D:
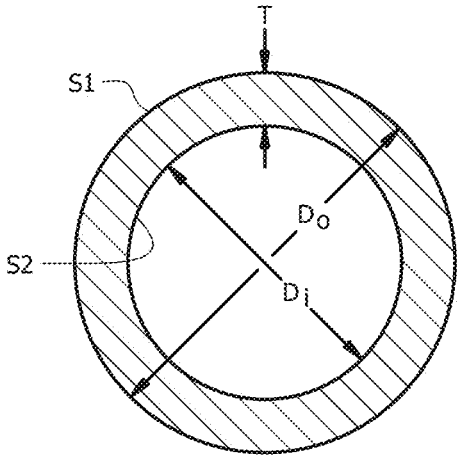
FIG. 4D is a front cross-section view of the hose of FIG. 4B and FIG. 4C.

As best depicted in FIG. 4D, which is a front cross-section view of the flexible hose 91A of FIG. 4B and FIG. 4C, flexible hose 91A comprises an outer or outside diameter $D_o$ defined by outer or outside surface S1 and an inner or inside diameter $D_i$ defined by inner or inside surface S2 separated by a thickness T (i.e., $D_o - D_i = T$). In embodiments, inside diameter $D_i$ is in a range of from about 1 to about 2 inches (from about 2.5 to about 5.1 cm), from about 2 inches to about 4 inches (from about 5.1 to about 10.2 cm), greater than or equal to about 0.5, 1, or 2 inches (1.27, 2.5, or 5.1 cm), and/or less than or equal to about 3, 4, or 6 inches (7.6, 10.2, or 15.1 cm). In embodiments, outside diameter $D_o$ is in a range of from about 1.5 to about 2.5 inches (from about 3.8 to about 6.4 cm), from about 2.5 to about 4.5 inches (from about 6.4 to about 11.4 cm), greater than or equal to about 1, 1.5, or 2.5 inches (2.5, 3.8, or 6.4 cm), and/or less than or equal to about 3.5, 4.5, or 6.5 inches (8.9, 11.4, or 16.5 cm). In embodiments, thickness T (e.g., T1/T2, described hereinbelow) is in a range of from about 0.05 to about 0.25 inch (from about 0.13 to about 0.64 cm), from about 0.25 to about 0.5 inch (from about 0.64 to about 1.3 cm), greater than or equal to about 0.05, 0.1, or 0.2 inch (0.13, 0.25, or 0.51 cm), and/or less than or equal to about 0.375, 0.5, or 1 inch (0.85, 1.3, or 2.5 cm). As detailed further hereinbelow, in embodiments, a first section 92 of flexible hose 91A has a different first inside diameter $D_{1i}$, first outside diameter $D_{1o}$, and/or first thickness T1 from a second inside diameter $D_{2i}$, second outside diameter $D_{2o}$ and/or second thickness T2 of one or more second sections 93 (e.g., 93A/93B) of flexible hose 91.

In embodiments, a flexible hose of this disclosure has a variable bend radius and/or stiffness, such that a bend radius and/or stiffness of a first section of the hose is different from a bend radius and/or stiffness of at least one second section of the hose, such that, during operation of the reciprocating pump, a stress on the first end of the hose, the second end of the hose, or both the first end of the hose and the second end of the hose is reduced relative to that of a hose that does not contain the variable bend radius and/or stiffness. In embodiments, the stress is different in different parts of the hose, although more even stresses are provided across the hose of this disclosure, in embodiments, to reduce or eliminate stress risers due to geometry. A flexible hose 91 of this disclosure can move stresses away from failure points (e.g., away from ends or extents E1/E2 described hereinbelow and toward a midpoint M) of a flexible hose 91/91A.

In this manner, the stiffness can change gradually from midpoint M to each of the ends of flexible hose 91/91A. Utilization of varying stiffness and/or bend radius in the second section(s) from that of the first section of flexible hose 91/91A can provide for a substantially uniform stress along the flexible hose 91/91A during operation, thus eliminating the stress concentrations, e.g., at any abrupt junctions, such as between the first extent E1 and the reciprocating element end of movable manifold 80A/80A' and/or between the second extent E2 and the fluid intake end of movable manifold 80A/80A'. For example, in embodiments, flexible hose 91/91A is thicker near the ends (e.g., fluid intake end 82A and/or reciprocating element end 81A) thereof, such that there isn't a dramatic change in stiffness between the hose in the freespan and at the rigid connections on first extent E1 and second extent E2.

As utilized herein a "bend radius" is a radius, measured on inside curvature, that hose 91A is bent by a given force. For example, with reference to the embodiment of FIG. 4B and FIG. 4C, in embodiments, first section 92 has a bend radius that is different from a bend radius of a first second section 93A and/or a second second section 93B of flexible hose 91A. In embodiments, the first section 92 comprises a midpoint M of flexible hose 91A located a distance L/2 along the centerline C of flexible hose 91A from first extent E1 of the reciprocating element end 81A of flexible hose 91A and second extent E2 of the second or fluid intake end 82A of flexible hose 91A. In embodiments, the first bend radius is less than the second bend radius. In embodiments, length L of flexible hose 91/91A is in a range of from about 12 to about 90 inches (from about 30.5 to about 228.6 cm), from about 12 to about 24 inches (from about 30.5 to about 61.0 cm), from about 12 to about 48 inches (from about 30.5 to about 121.9 cm), from about 48 to about 90 inches (from about 121.9 to about 228.6 cm), greater than or equal to about 12, 24, or 36 inches (30.5, 61.0, or 91.4 cm), and/or less than or equal to about 48, 60, or 90 inches (121.9, 152.4, or 228.6 cm). In embodiments, midpoint M, which is located the distance L/2 along the centerline C of flexible hose 91A from first extent E1 of reciprocating element end 81A of flexible hose 91A and second extent E2 of fluid intake end 82A of flexible hose 91A), is thus located a distance in a range of from about 6 to about 24 inches (from about 15.2 to about 61.0 cm), from about 24 to about 45 inches (from about 61.0 to about 114.3 cm), greater than or equal to about 6, 12, or 18 inches (15.2, 30.5, or 45.7 cm), and/or less than or equal to about 24, 30, or 45 inches (61.0, 76.2, or 114.3 cm) along centerline C of flexible hose 91A from first extent E1 of reciprocating element end 81A of flexible hose 91A and second extent E2 of fluid intake end 82A of flexible hose 91A.

In embodiments, the at least one second section comprises a section of the hose located within and/or comprising more than, less than, or about 10, 15, 20, 25, or 30% of the length L of the hose from the first end of the hose, a section of the hose located within and/or comprising more than, less than, or about 10, 15, 20, 25, or 30% of the length L of the hose from the second end of the hose, or both a section of the hose located within 10, 15, 20, 25, or 30% of the length L of the hose from the first end of the hose and a section of the hose located within 10, 15, 20, 25, or 30% of the length L of the hose from the second end of the hose. For example, with reference to the embodiment of FIG. 4B and FIG. 4C, flexible hose 91A comprise two second sections, including a first second section 93A of the flexible hose 91A located within and/or comprising more than, less than, or about 10, 15, 20, 25, or 30% of the length L of the flexible hose 91A from the first extent E1 of the flexible hose 91A and a second second section 93B of the flexible hose 91A located within and/or comprising more than, less than, or about 10, 15, 20, 25, or 30% of the length L of the flexible hose 91A from the second extent E2 of the flexible hose 91A. In embodiments, first second section 93A comprises the section of flexible hose 91A providing the first 10, 15, 20, 25, or 30% of the length L of the flexible hose 91A from the first extent E1 of the flexible hose 91A (i.e., the section of flexible hose 91A extending a distance less than or equal to about 0.1 L, 0.2 L, 0.3 L from first extent E1 along centerline C of flexible hose 91A toward second extent E2 of flexible hose 91A). In embodiments, second second section 93B comprises the section of flexible hose 91A providing the first 10, 15, 20, 25, or 30% of the length L of the flexible hose 91A from the second extent E2 of the flexible hose 91A (i.e., the section of flexible hose 91A extending a distance less than or equal to about 0.1 L, 0.15 L, 0.2 L, 0.25 L, 0.3 L from second extent E2 along centerline C of flexible hose 91A toward first extent E1 of flexible hose 91A).

As detailed further hereinbelow, in embodiments, the variable bend radius (e.g., the bend radii whereby a bend radius of a first section of the hose is different from a bend radius of at least one second section of the hose, such that, during operation of the reciprocating pump, a stress on the first end of the hose, the second end of the hose, or both the first end of the hose and the second end of the hose is reduced relative to that of a hose that does not contain the variable bend radius) can be provided by utilizing a different material for or as a component of the one or more second sections relative to the first section, a different thickness of the one or more second sections relative to a thickness of the first section, additional support material, such as wrappings, around, along, and/or as a component of the one or more second sections relative to the first section, or a combination thereof.

In embodiments, second section(s) 93A/93B of this disclosure provide for a transition between a more flexible hose (e.g., of first section 92) and the rigid connections with which first extent E1 and/or second extent E2 of flexible hose 91 is coupled. This transition can reduce the fatigue stress within flexible hose type movable manifold 80A' at and/or near the connection points between the first extent E1 of flexible hose 91A and reciprocating element end 81 of movable manifold 80 (and/or directly with reciprocating element 18 and/or a reciprocating element adapter 40) and/or between second extent E2 of flexible hose 91 and fluid intake end 82 of movable manifold 83 (and/or directly with stationary fluid intake manifold 83). As described hereinbelow, enforcements can be provided to first extent E1 and second extent E2, for example, externally, such as via added on supports (e.g., wound wire, stiff sleeve, etc.), and/or can be made into the hose structure of second section(s) 93A/93B, such as via a gradual thickening of the wall thickness T as rigid connections are approached. In embodiments, the material of the second sections 93A/93B provides a stiffer composition therein.

With reference back to FIG. 4D, in embodiments, the inner surface S2 of flexible hose 91A defines the inside diameter (ID) $D_i$ of flexible hose 91A, and the ID $D_i$ of flexible hose 91A is substantially constant along at least about 80, 90, or 100% of the length L of the flexible hose 91A. In embodiments, the thickness T1 (e.g., the difference between the outside diameter of the first section and the inside diameter of the first section: $D_{1o}$-$D_{1i}$) of the first section 92 of flexible hose 91A is less than the thickness T2 of the at least one second section 93A/93B of flexible hose 91A. For example, in embodiments, flexible hose 91A has an increased thickness at the reciprocating element end 81A and/or the fluid intake end 82A thereof (e.g., T2'/T2", where T2' is the thickness of the first second section 93A, which is the difference between the outside diameter of the first second section and the inside diameter of the first second section: $D_{2Ao}$-$D_{2Ai}$, and T2" is the thickness of the second second section 93B, which is the difference between the outside diameter of the second second section and the inside diameter of the second second section: $D_{2Bo}$-$D_{2Bi}$). For example, in the embodiment of FIG. 4B and FIG. 4C, first section 92 of flexible hose 91A has a thickness T1, first second section 93A has a thickness T2', and second second section 93B has a thickness T2". In embodiments, thickness T1 is less than or equal to the thickness T2' of first second section and/or the thickness T2" of second second section 93B. In embodiments, thickness T2' of first second section 93A is substantially equal to the thickness T2" of second second section 93B. In embodiments, thickness T2' of first second section 93A is greater than or less than the thickness T2" of second second section 93B. In embodiments, thickness T2' of first second section 93 and/or thickness T2" of second second section 93B is greater than or equal to about 10, 20, 30, or 40% greater than thickness T1 of first section 92. In some such embodiments wherein the thickness T1 of the first section 92 of flexible hose 91A is less than the thickness T2'/T2" of the at least one second section 93A/93B of flexible hose 91A, the first section 92 of flexible hose 91A comprises midpoint M of flexible hose 91A located distance L/2 along the centerline C from first extent E1 and second extent E2 of flexible hose 91A, and the at least one second section 93A/93B comprises a section of flexible hose 91A located within and/or comprising 10, 15, 20, 25, or 30% of the length L of flexible hose 91A from first extent E1 of flexible hose 91A, a section of flexible hose 91A located within and/or comprising more than, less than, or about 10, 15, 20, 25, or 30% of the length L of flexible hose 91A from second extent E2 of flexible hose 91A, or both a section of flexible hose 91A located within and/or comprising more than, less than, or about 10, 15, 20, 25, or 30% of the length L of flexible hose 91A from first extent E1 of flexible hose 91A and a section of flexible hose 91A located within and/or comprising more than, less than, or about 10, 15, 20, 25, or 30% of the length L of flexible hose 91A from second extent E2 of flexible hose 91A. In embodiments, thickness T1 of first section 92 is in a range of from about 0.1 to about 0.25 inch (from about 0.25 to about 0.64 cm), from about 0.25 to about 0.5 inch (from about 0.64 to about 1.3 cm), greater than or equal to about 0.1, 0.2, or 0.3 inch (0.25, 0.51, or 0.76 cm), and/or less than or equal to about 0.5, 0.6, or 0.7 inch (1.3, 1.5, or 1.8 cm). In embodiments, thickness T2 (e.g., T2'/T2") of the one or more second sections 93A/93B is in a range of from about 0.15 to about 0.25 (from about 0.38 to about 0.64 cm), from about 0.25 to about 0.35 inch (from about 0.64 to about 0.89 cm), greater than or equal to about 0.05, 0.1, or 0.15 inch (0.13, 0.25, or 0.38 cm), and/or less than or equal to about 0.3, 0.4, or 0.5 inch (0.76, 1.0, or 1.3 cm).

In embodiments, a stiffness of the at least one second section 93A/93B of flexible hose 91A is greater than a stiffness of the first section 92 of flexible hose 91A, wherein the stiffness is determined as the amount of force required to bend the flexible hose 91A around a desired radius. In this manner, flexible hose 91A can be stiffer near the ends (e.g., approaching first extent E1 and second extent E2 of flexible hose 91A from midpoint M) and the stiffness can, in embodiments, transition in a gradual way.

In embodiments, flexible hose 91/91A is flexible in bending, and stiff radially (e.g., such that diameter D thereof doesn't change much or at all during operation) but has a lower stiffness in the longitudinal/axial direction (e.g., along length L of flexible hose 91A). Such embodiments may provide for a longer hose life due to flexure. For example, such stiffness can be provided, in embodiments, by utilizing spiral wound wire around second section(s) 93A/93B, rather than braided stiffeners. In embodiments, the one or more second sections 93A/93B are increased in stiffness via reinforcing the second sections, for example, via wrapping. In embodiments, all or a portion of each second section 93A/93B is reinforced via wire wrapping (e.g., spiral wound wrapping, braided wrapping, etc.), a sleeve, or the like. The wire winding, sleeve, or the like can be external (e.g., on or around outside surface S1 of flexible hose 91A) and/or internal (within diameter D1 and/or contacting inside surface S2). In embodiments, the first section 92 of flexible hose 91A comprises midpoint M of flexible hose 91A located distance L/2 along the centerline A from the first extent E1 of flexible hose 91A and from second extent E2 of flexible hose 91A. In some such embodiments wherein a stiffness (e.g., in the axial direction) of the at least one second section 93A/93B of flexible hose 91A is greater than a stiffness (e.g., in the axial direction) of the first section 92 of flexible hose 91A, the first section 92 of flexible hose 91A comprises midpoint M of flexible hose 91A located distance L/2 along the centerline C from first extent E1 and second extent E2 of flexible hose 91A, and the at least one second section 93A/93B comprises a section of flexible hose 91A located within and/or comprising 10, 15, 20, 25, or 30% of the length L of flexible hose 91A from first extent E1 of flexible hose, a section of flexible hose 91A located within and/or comprising more than, less than, or about 10, 15, 20, 25, or 30% of the length L of flexible hose 91A from second extent E2 of flexible hose 91A, or both a section of flexible hose 91A located within and/or comprising more than, less than, or about 10, 15, 20, 25, or 30% of the length L of flexible hose 91A from first extent E1 of flexible hose 91A and a section of flexible hose 91A located within and/or comprising more than, less than, or about 10, 15, 20, 25, or 30% of the length L of flexible hose 91A from second extent E2 of flexible hose 91A.

In embodiments, the at least one second section 93A/93B includes a section of flexible hose 91A comprising a material that is different (i.e., comprises a different composition and/or material component(s)) from a material of first section 92 of flexible hose 91A and/or comprises a greater amount (e.g., mass per unit area of flexible hose 91A) of the material of the first section 92 of flexible hose 91A than an amount of the material of the first section 92 of flexible hose 91A in the first section 92 of flexible hose 91A. In embodiments, the at least one second section 93A/93B of flexible hose 91A includes a section of flexible hose 91A comprising an additional support material relative to the first section 92 of flexible hose 91A. In some such embodiments, the first section 92 of flexible hose 91A comprises midpoint M of flexible hose 91A located distance L/2 along the centerline C from first extent E1 and second extent E2 of flexible hose 91A, and the at least one second section 93A/93B comprises a section of flexible hose 91A located within and/or comprising 10, 20, 25, or 30% of the length L of flexible hose 91A from first extent E1 of flexible hose, a section of flexible hose 91A located within and/or comprising more than, less than, or about 10, 20, 25, or 30% of the length L of flexible hose 91A from second extent E2 of flexible hose 91A, or both a section of flexible hose 91A located within and/or comprising more than, less than, or about 10, 20, 25, or 30% of the length L of flexible hose 91A from first extent E1 of flexible hose 91A and a section of flexible hose 91A located within and/or comprising more than, less than, or about 10, 20, 25, or 30% of the length L of flexible hose 91A from second extent E2 of flexible hose 91A. In embodiments, the inner surface S2, the outer surface S1, or both the inner surface S2 and the outer surface S1 of flexible hose 91A within the second section of flexible hose 91A comprising the material that is different from the material of first section 92 of flexible hose 91A comprises the additional support material. In embodiments, the additional material comprises an additive. For example, in embodiments, the first section 92 of flexible hose 91A comprises a polymer, and the at least one second section 93A/93B of flexible hose 91A comprises the polymer comprising at least one additional additive. Thus, in embodiments, the first section 92 comprises a polymer and the at least one second section 93A/93B comprises a composite thereof. Without limitation, the at least one additional additive can comprise, for example, one or more wires, fibers, or meshes, or a combination thereof. Such wires, fibers, or meshes can be, for example, continuous, woven, wound, or chopped, and can be made from metals, fiberglass, Kevlar, or other polymer fibers.

In embodiments, flexible hose 91 be made in a desired shape (e.g., an elbow or other geometry), such that flexible hose 91 is in a state of minimum (e.g., no) stress when connected with the pump 10 at mid stroke. In such embodiments, stress will occur only or primarily at the ends of the pump stroke (e.g., at TDC and BDC) and there will be no mean stress due to bending an initially straight hose into the requisite bent position. Thus, according to embodiments of this disclosure, a flexible hose 91 of a flexible hose type movable manifold 80 can be preformed such that, at rest, the hose assumes a configuration in which the hose comprises the variable bend radius wherein the bend radius of the first section of the hose is different from the bend radius of the at least one second section of the hose. In embodiments, the configuration comprises a mid-stroke configuration the flexible hose 91 takes or assumes during operation of the reciprocating pump 10 when a reciprocating element 18 of the reciprocating pump is at a midpoint (e.g., between TDC and BDC) of a stroke of a pump power end 12 of the reciprocating pump 10, such that flexible hose 91 is in a substantially unstressed (or neutral) position each time the pump 10 is at the midpoint of a stroke. The midpoint of the stroke is halfway between a fully extended position (e.g., TDC) and a fully retracted position (e.g., BDC) of the reciprocating element 18. In embodiments, in the mid-stroke configuration, the first section has a bend radius in a range of from ¼ to four times a stroke length of the reciprocating pump, wherein the stroke length is a distance traveled by a reciprocating element of the reciprocating pump from top dead center (TDC) to bottom dead center (BDC). In embodiments, in the mid-stroke configuration, each at least one second section 93A/93B has a radius of curvature that transitions (e.g., continuously or in a stepwise manner) along a length thereof from the bend radius of the first section in the mid-stroke configuration to an infinite bend radius.

In embodiments, the reciprocating element end 81A of flexible hose 91, fluid intake end 82A of flexible hose 91, or both the reciprocating element end 81A of flexible hose 91 and fluid intake end 82A of flexible hose 91 comprises and/or is fluidly connected to a rigid metal connection. For example, in the embodiment of FIG. 4B and FIG. 4C, fluid intake end 82A of flexible hose 91A can be fluidly connected to stationary fluid manifold 83 via rigid metal connection of fluid intake end 82 of movable manifold 80A, and reciprocating element end 81A of flexible hose 91A can be fluidly connected with reciprocating element 18 (e.g., directly or via a reciprocating element adapter (FIG. 8) via a metal connection of reciprocating element end 81 of movable manifold 83. That is, reciprocating element end 81 and/or fluid intake end 82 of a movable manifold 80 according to this disclosure can comprise a metal connection configured for coupling with reciprocating element end 81A and/or fluid intake end 82A, respectively, of flexible hose 91A. Coupling can comprise, for example, threading, clamping, wrapping, gluing, interference fits, barbed fittings, or a combination thereof.

Figure 4E:
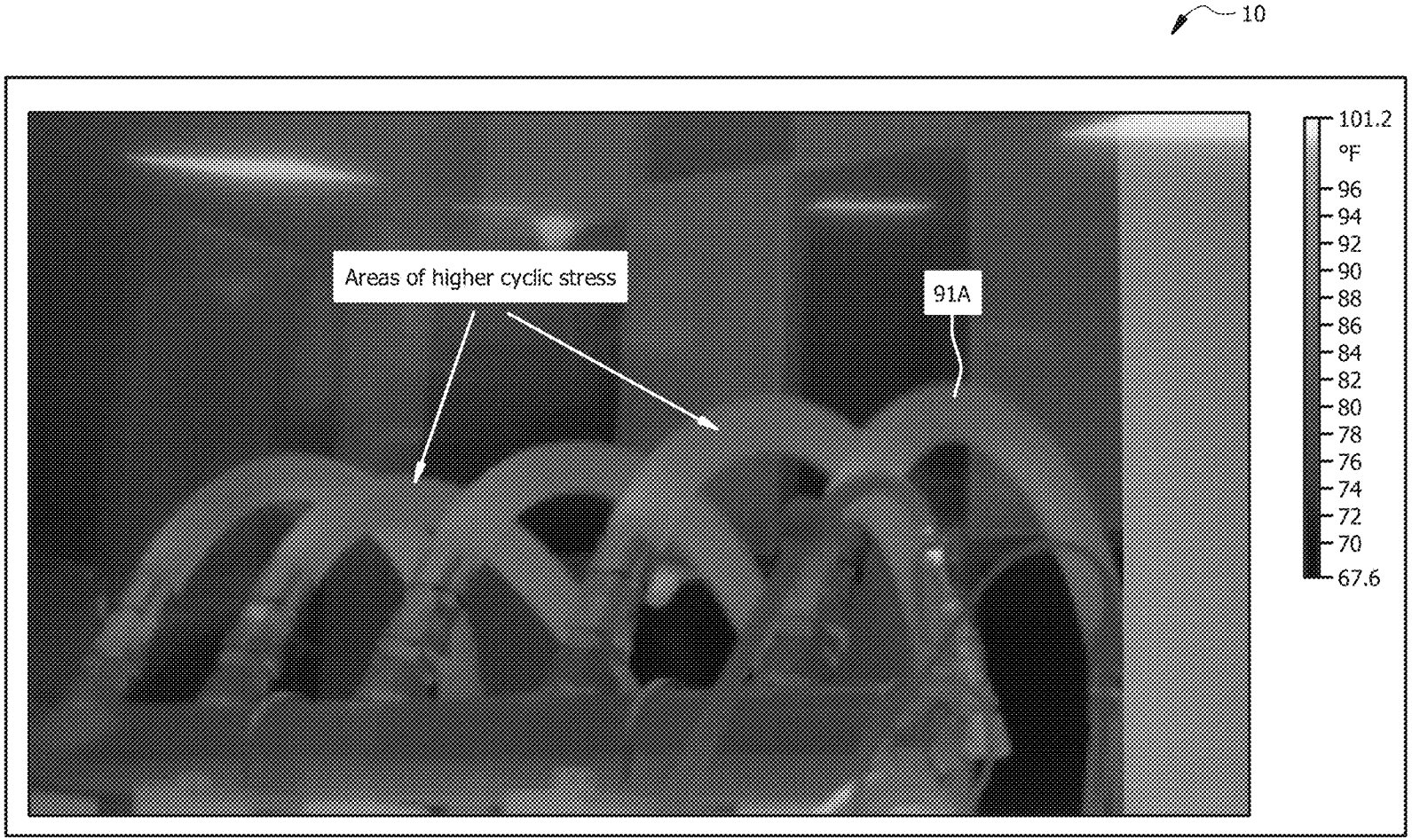
FIG. 4E is a thermal image of flexible hoses introducing fluid to a hollow reciprocating element of a reciprocating pump comprising a concentric bore pump fluid end, according to embodiments of this disclosure.

FIG. 4E shows thermal images of flexible hoses 91A during operation of a Quintuplex pump 10 comprising same. As can be seen in FIG. 4E, the thermal images suggest that the strains occurring in the fatigue locations (e.g., first extent E1 and second extent E2 of flexible hose 91A) have been moved primarily to midpoint M of flexible hoses 91. (That is, the arrows are directed to the midpoint M of the hoses, rather than the extents or ends thereof where stresses are higher.) During pumping operations, the flexible hoses 91A are internally cooled with slurry.

Figure 5A:
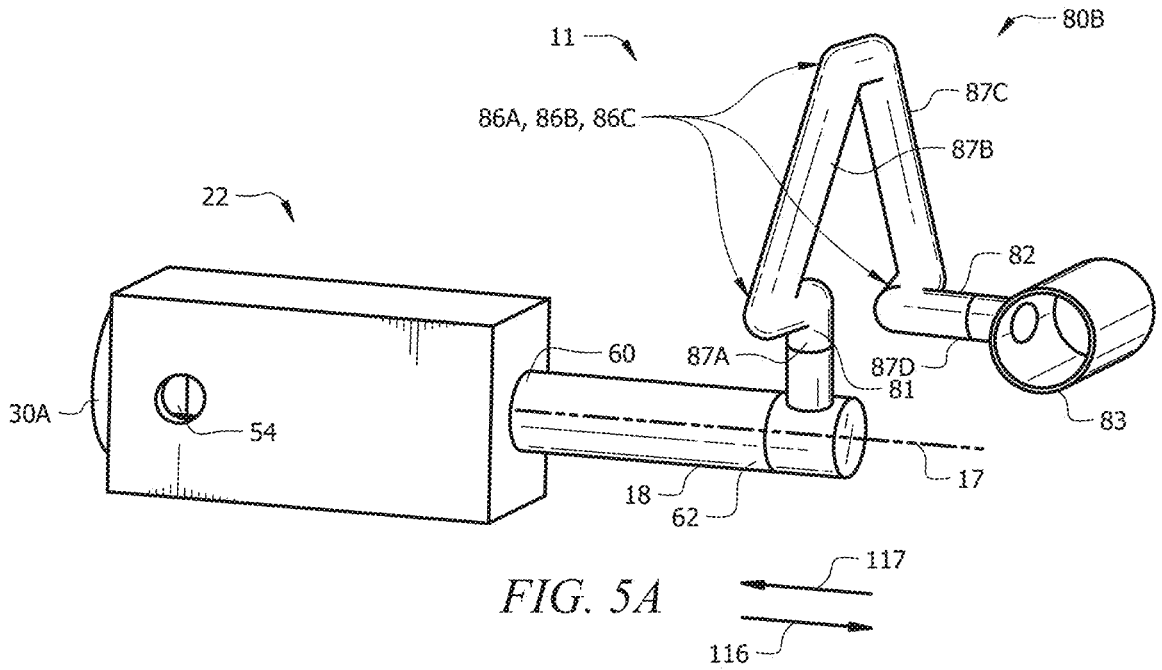
FIG. 5A is a schematic of an integration section of a pump comprising a swivel and seal type movable manifold in a fully retracted configuration, according to embodiments of the present disclosure.
Figure 5B:
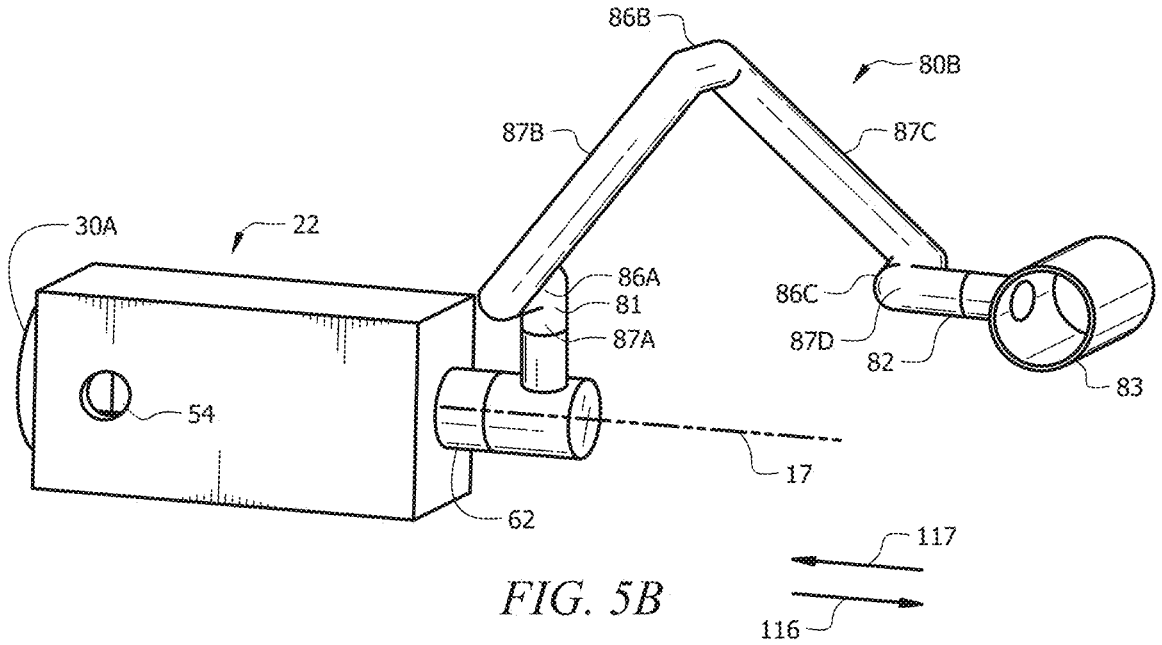
FIG. 5B is a schematic of the integration section of FIG. 5A, wherein the swivel and seal type movable manifold is in a fully extended configuration.

In embodiments, movable manifold 80 is a swivel and seal type movable manifold. FIG. 5A is a schematic of an integration section 11 of a pump 10 comprising a swivel and seal movable manifold 80B, according to embodiments of the present disclosure, with reciprocating element 18 fully retracted (e.g., crank arm 20 of a pump 10 comprising swivel and seal manifold 80B at TDC). FIG. 5B is a schematic of the integration section 11 comprising the swivel and seal movable manifold 80B of FIG. 5A, with reciprocating element 18 fully extended (e.g., crank arm 20 of a pump 10 comprising swivel and seal type manifold 80B at BDC). In the embodiment of FIGS. 5A and 5B, movable manifold 80 (FIG. 3) comprises a swivel and seal movable manifold 80B. A swivel and seal type movable manifold, such as swivel and seal manifold 80B, comprises a plurality of hollow rigid elements, wherein each hollow rigid element is fluidly connected with at least one other hollow rigid element via a swivel and seal element, with one of the hollow rigid elements comprising the reciprocating element end 81 of the swivel and seal movable manifold 80B and another of the plurality of hollow rigid elements comprising the fluid intake end 82 of the swivel and seal movable manifold 80B.

The swivel and seal movable manifold 80B of the embodiment of FIGS. 5A and 5B comprises four hollow rigid elements (e.g., lengths of pipe, tubing, conduit or the like), wherein a first of the hollow rigid elements 87A has a first end comprising the reciprocating element end 81 of the swivel and seal movable manifold 80B and a second end thereof rotatably connected with a second hollow rigid element 87B via a first swivel and seal element 86A. The second hollow rigid element 87B comprises a first end rotatably connected with the first hollow rigid element 87A and a second end rotatably connected with a third hollow rigid element 87C via a second swivel and seal element 86B. The third hollow rigid element 87C comprises a first end rotatably connected with the second hollow rigid element 87B and a second end rotatably connected with a fourth hollow rigid element 87D via a third swivel and seal element 86C. The fourth hollow rigid element 87D comprises a first end rotatably connected with the third hollow rigid element 87C and a second end comprising the fluid intake end 82 of the swivel and seal movable manifold 80B. Fluid intake end 82 of flexible hose movable manifold 80B is fluidly coupled with stationary fluid manifold 83 and remains stationary with reference to central axis 17.

Other swivel and seal type movable manifolds (e.g., having a differing number of hollow rigid elements and/or swivel and seal elements) can be envisioned by one of skill in the art with the help of this disclosure, and are within the scope of this disclosure.

Figure 6A:
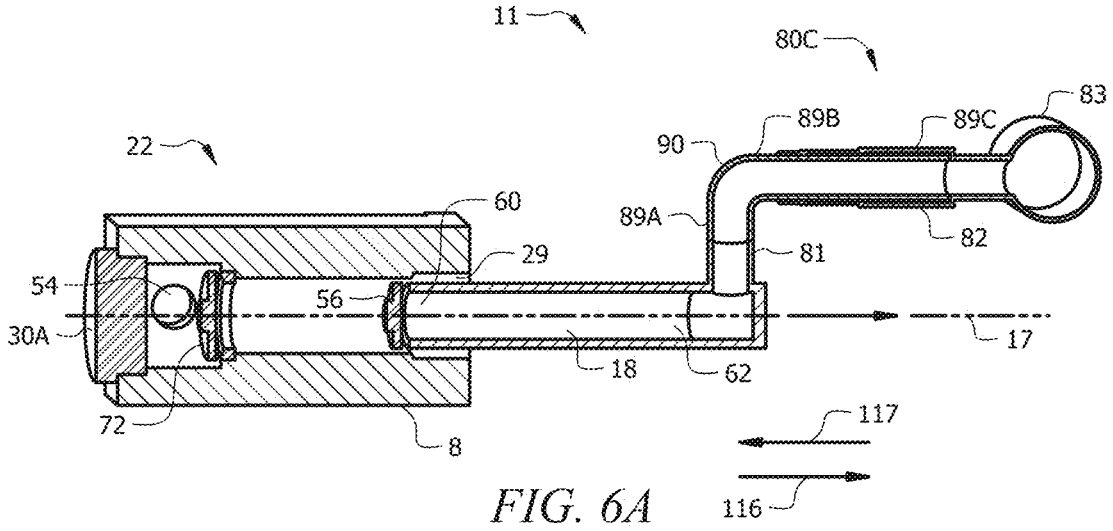
FIG. 6A is a schematic of an integration section of a pump comprising a trombone type movable manifold in a fully retracted configuration, according to embodiments of the present disclosure.
Figure 6B:
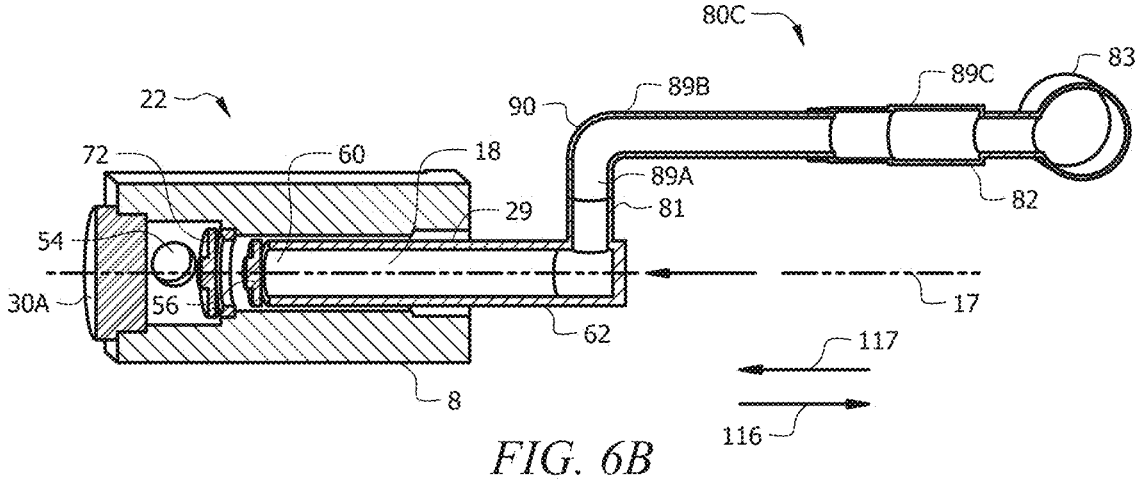
FIG. 6B is a schematic of the integration section of FIG. 6A, wherein the trombone type movable manifold is in a fully extended configuration.

In embodiments, movable manifold 80 is a trombone type movable manifold. FIG. 6A is a schematic of an integration section 11 of a pump 10 comprising a trombone type movable manifold 80C, according to embodiments of the present disclosure, with reciprocating element 18 fully retracted (e.g., crank arm 20 of a pump 10 comprising trombone type movable manifold 80B at TDC). FIG. 6B is a schematic of the integration section 11 comprising the trombone type movable manifold 80C of FIG. 6A, with reciprocating element 18 fully extended (e.g., crank arm 20 of a pump 10 comprising swivel and seal type manifold 80B at BDC). In the embodiment of FIGS. 6A and 6B, movable manifold 80 (FIG. 3) comprises a trombone type movable manifold 80C.

Trombone type movable manifold 80C of the embodiment of FIG. 6A and FIG. 6B comprises a first hollow rigid portion 89A (e.g., a length of pipe, tubing, conduit or the like), a second hollow rigid portion 89B (e.g., a length of pipe, tubing, conduit or the like), a third hollow rigid portion 89C (e.g., a length of pipe, tubing, conduit or the like), and a sealing element. The first hollow rigid portion 89 comprises the reciprocating element end 81 of the trombone type movable manifold 80C and is fluidly connected with the second rigid hollow portion 89B via an elbow 90, whereby the second hollow rigid portion 89B is substantially parallel with the reciprocating element bore 24. The second hollow rigid portion 89B is positioned within (e.g., concentric with) the third hollow rigid portion 89C forming an annular space, and thus the outside diameter of the second hollow rigid portion 89B is less than the inside diameter of the third hollow rigid portion 89C such that the second hollow rigid portion 89B can move axially parallel to central axis 17 while inside third hollow rigid portion 89C. The sealing element is positioned in the annular space and surrounds at least a portion of outer surface of the second hollow rigid portion 89B and the inner surface of third hollow rigid portion 89A, and allows for reciprocation of the second hollow rigid portion 89B along a path within the third hollow rigid portion 89C substantially concurrently with the reciprocation of the reciprocating element 18 in the reciprocating element bore 24. The third hollow rigid portion 89C comprises fluid intake end 82, and fluid intake end 82 of trombone type movable manifold 80C is fluidly coupled with stationary fluid manifold 83 and remains stationary with reference to central axis 17. In the embodiment of trombone type movable manifold 80C of FIGS. 6A and 6B, the sealing element can comprise a sealing element 29B.

In embodiments, the first hollow rigid portion 89A, the second hollow rigid portion 89B, and the elbow 90 of a trombone type movable manifold 80C comprises a unitary body. In embodiments, the elbow 90 defines a 90 degree angle between the first hollow rigid portion 89A and the second hollow rigid portion 89B. Other trombone type movable manifolds can be envisioned by one of skill in the art with the help of this disclosure, and are within the scope of this disclosure.

Figure 7A:
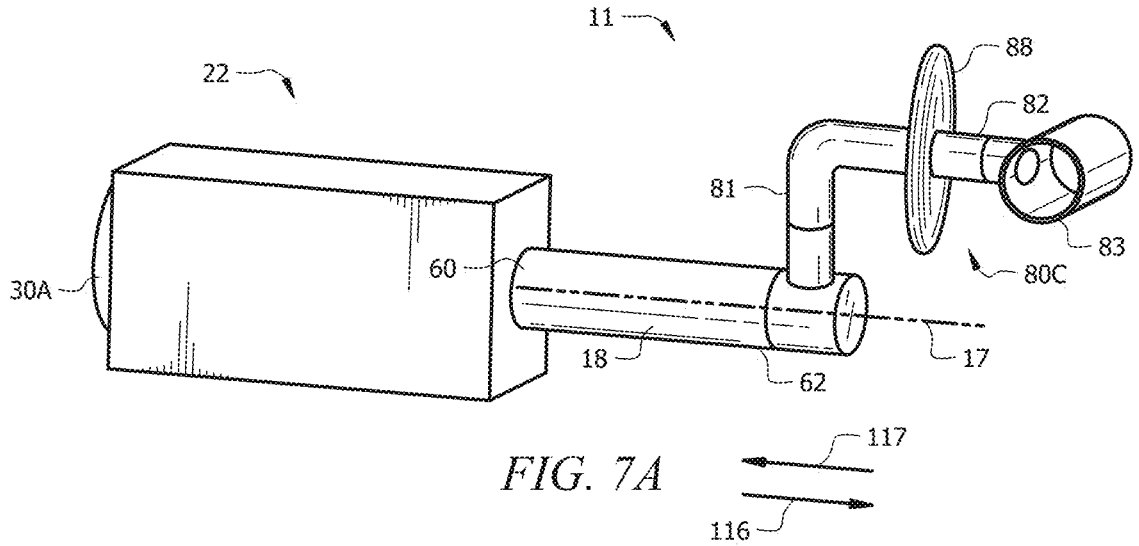
FIG. 7A is a schematic of an integration section of a pump comprising a bellows type movable manifold in a fully retracted configuration, according to embodiments of the present disclosure.
Figure 7B:
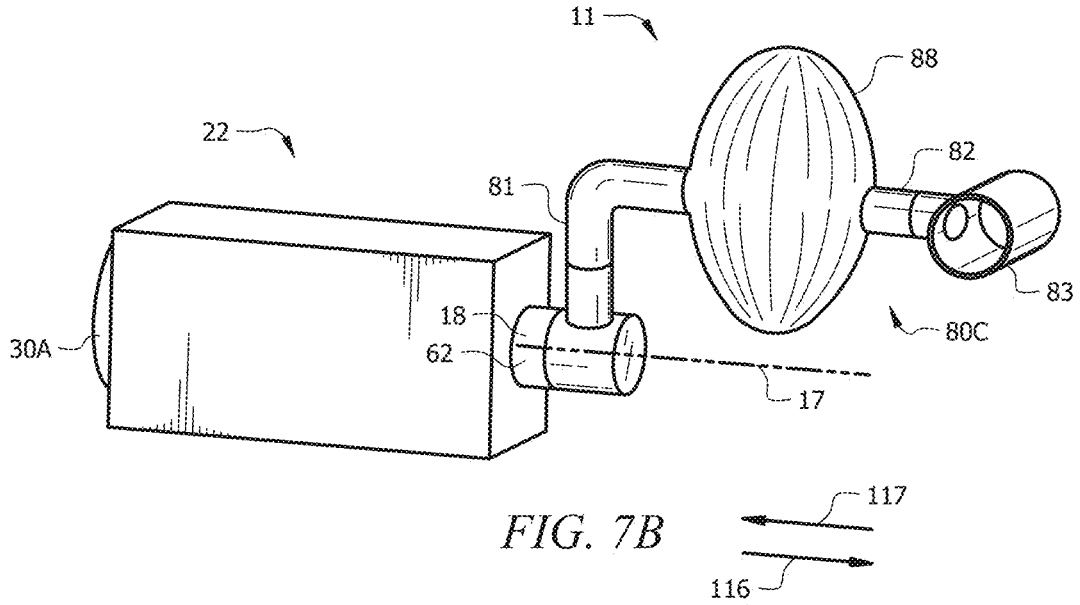
FIG. 7B is a schematic of the integration section of FIG. 7A, wherein the bellows type movable manifold is in a fully extended configuration.

In embodiments, movable manifold 80 is a bellows type movable manifold. FIG. 7A is a schematic of an integration section 11 of a pump 10 comprising a bellows type movable manifold 80D, according to embodiments of the present disclosure, with reciprocating element 18 fully retracted (e.g., crank arm 20 of a pump 10 comprising bellows type manifold 80D at TDC). FIG. 7B is a schematic of the integration section 11 comprising the bellows type movable manifold 80D of FIG. 7A, with reciprocating element 18 fully extended (e.g., crank arm 20 of a pump 10 comprising bellows type manifold 80D at BDC). In the embodiment of FIGS. 7A and 7B, movable manifold 80 (FIG. 3) comprises a bellows type movable manifold 80D.

Bellows type movable manifold 80D comprises a bellows 88. Bellows 88 is fluidly connected via reciprocating element intake end 81 to reciprocating element 18 and via fluid intake end 82 with stationary fluid manifold 83. Other bellows type movable manifolds comprising a bellows 88 that expands (e.g., expands and contracts in an accordion-like fashion) can be envisioned by one of skill in the art with the help of this disclosure, and are within the scope of this disclosure. For example, without limitation, a bellows type movable manifold can have a substantially uniform outer diameter along a central axis thereof parallel to central axis 17. For example, without limitation, a bellows 88 can be made of any suitable material such as an elastomer, synthetic rubber, etc. of the type that is resistant to degradation from contact with a wellbore servicing fluid.

The reciprocating element end 81 of the movable manifold 80 (e.g., 80A, 80B, 80C, or 80D) can be fluidly connected with the reciprocating element via any means, such that fluid can be introduced into tail end 62 of reciprocating element 18. Similarly, the fluid intake end 82 of the movable manifold 80 (e.g., 80A, 80B, 80C, or 80D) can be fluidly connected with the stationary fluid manifold 83 via any means, such that fluid can be introduced into the movable manifold from the stationary fluid manifold 83.

As noted hereinabove, in embodiments, one or more additional components or mechanical linkages 4 (FIG. 3) are utilized to couple the reciprocating element 18 to the pump power end 12 (e.g., to a crank arm 20 and/or pushrod 30). For example, tail end 62 of reciprocating element 18 can be coupled to the pump power end 12 via an adapter, a clamp, a pushrod, an extension, or a combination thereof. In an embodiment, tail end 62 of reciprocating element 18 can be releasably coupled to the pump power end 12 via a reciprocating element adapter that is mechanically coupled (either directly or indirectly) with crank arm 20 (e.g., via pushrod 30) of pump power end 12 and further releasably mechanically coupled (e.g., via a threaded connection) with the tail end 62 of reciprocating element 18.

Figure 8:
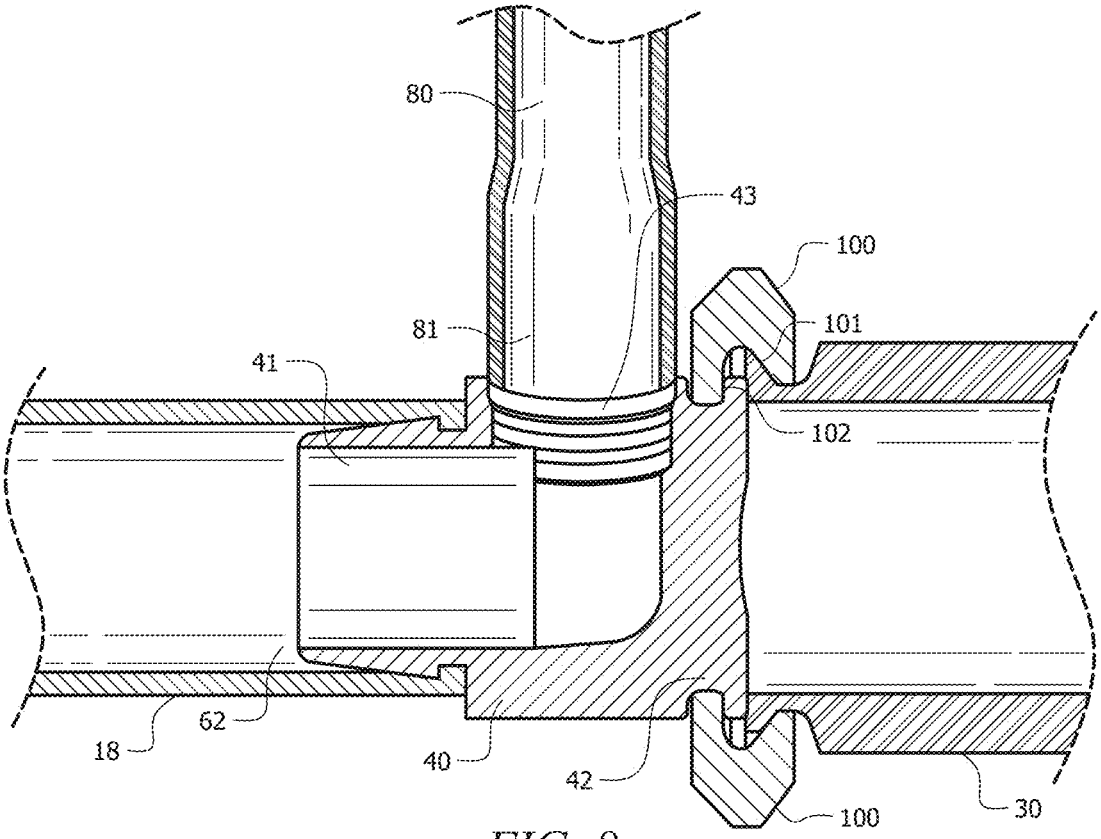
FIG. 8 is a schematic of a reciprocating element adapter coupling a reciprocating element with a pushrod and a movable manifold, according to embodiments of this disclosure.

In embodiments, reciprocating element 18 is coupled with a pushrod 30 of pump power end 12 via a reciprocating element adapter, as described, for example, in U.S. patent application Ser. No. 16/411,894, which is being filed on May 14, 2019 and is entitled "Easy Change Pump Plunger", the disclosure of which is hereby incorporated herein in its entirety for purposes not contrary to this disclosure. FIG. 8 is a schematic of a reciprocating element adapter 40 coupling fluid intake end 62 of a reciprocating element 18 with a pushrod 30 of pump power end 12 and reciprocating element end 81 of a movable manifold 80, according to embodiments of this disclosure. In such embodiments, the one or more mechanical linkages 4 comprise reciprocating element adapter 40. In embodiments, the reciprocating element end 81 of the movable manifold (e.g., movable manifold 80, flexible hose movable manifold 80A, swivel and seal movable manifold 80B, trombone type movable manifold 80C, or bellows type movable manifold 80D) is fluidly connected with the fluid intake end 62 of the reciprocating element 18 via an inlet port 43 of a reciprocating element adapter (also referred to as a plunger adapter) 40. That is, in embodiments, fluid does not flow directly from the movable manifold 80 into the reciprocating element 18, but is introduced from the reciprocating element end 81 of the movable manifold 80 directly into a reciprocating element adapter 40 that is itself coupled proximate the tail end 62 of reciprocating element 18, and the fluid further flows from there into the reciprocating element 18. The reciprocating element adapter 40 can be coupled to pump power end 12, such that power end 12 can operate to reciprocate reciprocating element 18 within reciprocating element bore 24. For example, in embodiments, such a reciprocating element adapter 40 can be coupled (e.g., via a clamp end 42 thereof) to a connecting rod 20 (or pushrod 30) of pump power end 12, for example, via a clamp 100. In embodiments, such a clamp can have a first contact surface 101 perpendicular to a central axis (e.g. central axis 17) of the clamp 100 and a second contact surface 102 tapered relative to a central axis (e.g., central axis 17) of the clamp 100 and fixedly couple the reciprocating element adapter 40 and the pushrod 30 via contact of the first contact surface 101 of the clamp 100 with a portion of the reciprocating element adapter 40 and contact of the second contact surface 102 of the clamp 100 with a portion of the pushrod 30.

In embodiments, the reciprocating element end 41 of the reciprocating element adapter 40 and the fluid intake end 62 of the reciprocating element 18 are threaded, whereby the fluid intake end 62 of the reciprocating element 18 can be threadably coupled with the reciprocating element end 41 of the reciprocating element adapter 40. In embodiments, the reciprocating element end 41 of the reciprocating element adapter 40 and the fluid intake end 62 of the reciprocating element 18 comprise tapered threads. In alternative embodiments, the reciprocating element end 41 of the reciprocating element adapter 40 and the fluid intake end 62 of the reciprocating element 18 comprise straight threads. In alternative embodiments, the reciprocating element adapter is an integral part of the reciprocating element 18 or the pushrod 30 (e.g., the reciprocating element 18 and the pushrod 30 can be coupled directly together). In such embodiments, fluid intake end 62 of reciprocating element 18 can comprise an inlet port whereby fluid can be introduced directly into fluid intake end 62 of reciprocating element 18 via reciprocating element end 81 of movable manifold 80. In other embodiments, the reciprocating element 18 can be coupled with the reciprocating element end 41 of the reciprocating element adapter 40 via a bolted flange or some type of quick connect, such as, for example, a hose barb, or the like.

As noted hereinabove, pump 10 of this disclosure can further comprise a primary reciprocating element packing 29 within pump fluid end 22, wherein the reciprocating element packing seals a space between a wall of the reciprocating element bore 24 and an outside of the peripheral wall 84 of the reciprocating element 18, providing a high pressure pump chamber 28 extending in an axial direction toward the front end 60 of the reciprocating element 18 from the reciprocating element packing 29. According to this disclosure, and contrary to conventional hollow reciprocating element 18 pump fluid end 22 embodiments, during operation of the pump 10, an outside of the peripheral wall 84 of a portion of the reciprocating element 18 is positioned outside the high pressure chamber 28 (e.g., positioned external to the primary reciprocating element packing 29 and extending from the pump fluid end 22 outward into the integration section 11) and does not contact a fluid being pumped by the pump 10. Thus, during operation of pump 10 of this disclosure, an outside of the peripheral wall 84 of a portion of the reciprocating element 18 positioned outside the high pressure chamber 28 does not contact a fluid being pumped by pump 10.

In embodiments, pump fluid end 22 comprises a packing assembly, such that packing 29, a packing carrier, and a packing screw can be removed from back S2 of pump fluid end 22 when crankshaft 16 is at TDC, as described, for example, in U.S. patent application Ser. No. 16/411,911, which is being filed on May 14, 2019 and is entitled "Pump Fluid End with Positional Indifference for Maintenance", the disclosure of which is hereby incorporated herein in its entirety for purposes not contrary to this disclosure.

As depicted in FIGS. 2, 4, 6A, and 6B, pump 10 can further comprises a suction valve assembly 56 coupled with (e.g., located at least partially within the front end 60 of) reciprocating element 18 and a discharge valve assembly 72 located at an end of the reciprocating element bore 24 distal the pump power end 12. In embodiments, discharge valve assembly 72 and/or suction valve assembly 56 comprises a valve assembly having a valve guide, as described, for example, in U.S. patent application Ser. No. 16/411,910, which is being filed on May 14, 2019 and is entitled "Valve Assembly for a Fluid End with Limited Access", the disclosure of which is hereby incorporated herein in its entirety for purposes not contrary to this disclosure. In embodiments, a discharge valve seat of discharge valve assembly 72 and/or a suction valve seat of suction valve assembly 56 is a valve seat with supplemental retention, as described, for example, in U.S. patent application Ser. No. 16/411,898, which is being filed on May 14, 2019 and is entitled "Pump Valve Seat with Supplemental Retention", the disclosure of which is hereby incorporated herein in its entirety for purposes not contrary to this disclosure. In embodiments, pump fluid end 22 is a pump fluid end 22 with an easy access suction valve, as described, for example, in U.S. patent application Ser. No. 16/411,891, which is being filed on May 14, 2019 and is entitled "Pump Fluid End with Easy Access Suction Valve", the disclosure of which is hereby incorporated herein in its entirety for purposes not contrary to this disclosure.

Pump 10 can be a multiplex pump comprising a plurality of reciprocating elements 18, and a corresponding plurality of reciprocating element bores 24, suction valve assemblies 56, discharge valve assemblies 72, and movable manifolds 80 (which can be any type of movable manifold described herein). The plurality can comprise any number such as, for example, 2, 3, 4, 5, 6, 7, or more. For example, in embodiments, pump 10 is a triplex pump, wherein the plurality comprises three. In alternative embodiments, pump 10 comprises a quintuplex pump, wherein the plurality comprises five.

Also disclosed herein is a method of servicing a pump 10 of this disclosure. According to this disclosure, a method of servicing a pump 10 of this disclosure comprises accessing the (primary) reciprocating element packing 29 that prevents fluid from leaking out of high pressure chamber 28. Via this disclosure, accessing the primary packing 29 is not complicated by (e.g., access to the primary packing 29 is not limited by) the presence of a second set of (e.g., lower pressure) packing associated with a low pressure chamber of the suction manifold (e.g., a lower pressure chamber of the suction manifold that is located in the integration section 11 and contains a portion of the reciprocating element (e.g., a slotted portion thereof) in a flooded state surrounded by the wellbore servicing fluid being pumped such that the fluid may flow through the slots into the hollow cylinder (e.g., bore) of the reciprocating element 18 and pass into pump chamber 28 via suction valve assembly 56), such as conventionally utilized to feed fluid into a hollow reciprocating element of a pump fluid end 22 design, as no such low pressure fluid chamber external reciprocating element 18 or secondary set of packing is utilized for pumping via a pump 10 of this disclosure (and thus the integration section 11 is not obstructed thereby and remains easily accessible such that maintenance can be performed on primary packing 29). In embodiments, accessing the reciprocating element packing 29 comprises accessing the reciprocating element packing 29 via the integration section 11. In embodiments, the ease of accessing the high pressure chamber 28 provided via this disclosure facilitates maintenance associated with changes of valve components (e.g., of suction valve assembly 56 and/or discharge valve assembly 72). In embodiments, servicing the pump does not require removal of flexible hose(s) 91/91A of this disclosure from pump 10 to replace the packing 29 or change the plunger(s)/reciprocating element(s) 18. In embodiments, design of flexible hose(s) 91/91A of pump 10 facilitate replacement thereof during servicing of pump 10.

In embodiments, a method of servicing a pump 10 according to this disclosure comprises: disconnecting movable manifold 80 of the pump 10 from reciprocating element 18 of pump 10, removing reciprocating element 18 from pump, accessing and/or servicing primary reciprocating element packing 29 of pump 10 via integration space 11 located between pump fluid end 22 of pump 10 and pump power end 12 of pump 10, and reconnecting movable manifold 80 with the or another reciprocating element 18. In embodiments, prior to servicing, the reciprocating element 18 is coupled to the movable manifold 80 and to a pushrod 30 of the power end 12 of the pump 10 via a reciprocating element adapter 40, and disconnecting the movable manifold 80 of the pump 10 from the reciprocating element 18 of the pump 10 comprises decoupling the reciprocating element 18 from the reciprocating element adapter 40. As noted above, in embodiments, the reciprocating element 18 is threadably coupled to the reciprocating element adapter 40, and removing the reciprocating element 18 from the pump 10 further comprises unthreading the reciprocating element 18 from the reciprocating element adapter 40, and reconnecting the movable manifold 80 with the or another reciprocating element 18 comprises rethreading the or the another reciprocating element 18 with the reciprocating element adapter 40.

In embodiments, removing the reciprocating element 18 from the pump 10 comprises removing the reciprocating element 18 via front S1 of pump fluid end 22 distal pump power end 12 of pump 10. In embodiments, reciprocating element 18 comprises tool engagement features on front 60 thereof, whereby reciprocating element 18 can be removed from pump fluid end 22 by engaging a tool with the engagement features, as described, for example, in U.S. patent application Ser. No. 16/411,905, which is being filed on May 14, 2019 and is entitled "Pump Plunger with Wrench Features", the disclosure of which is hereby incorporated herein in its entirety for purposes not contrary to this disclosure.

Figure 9:
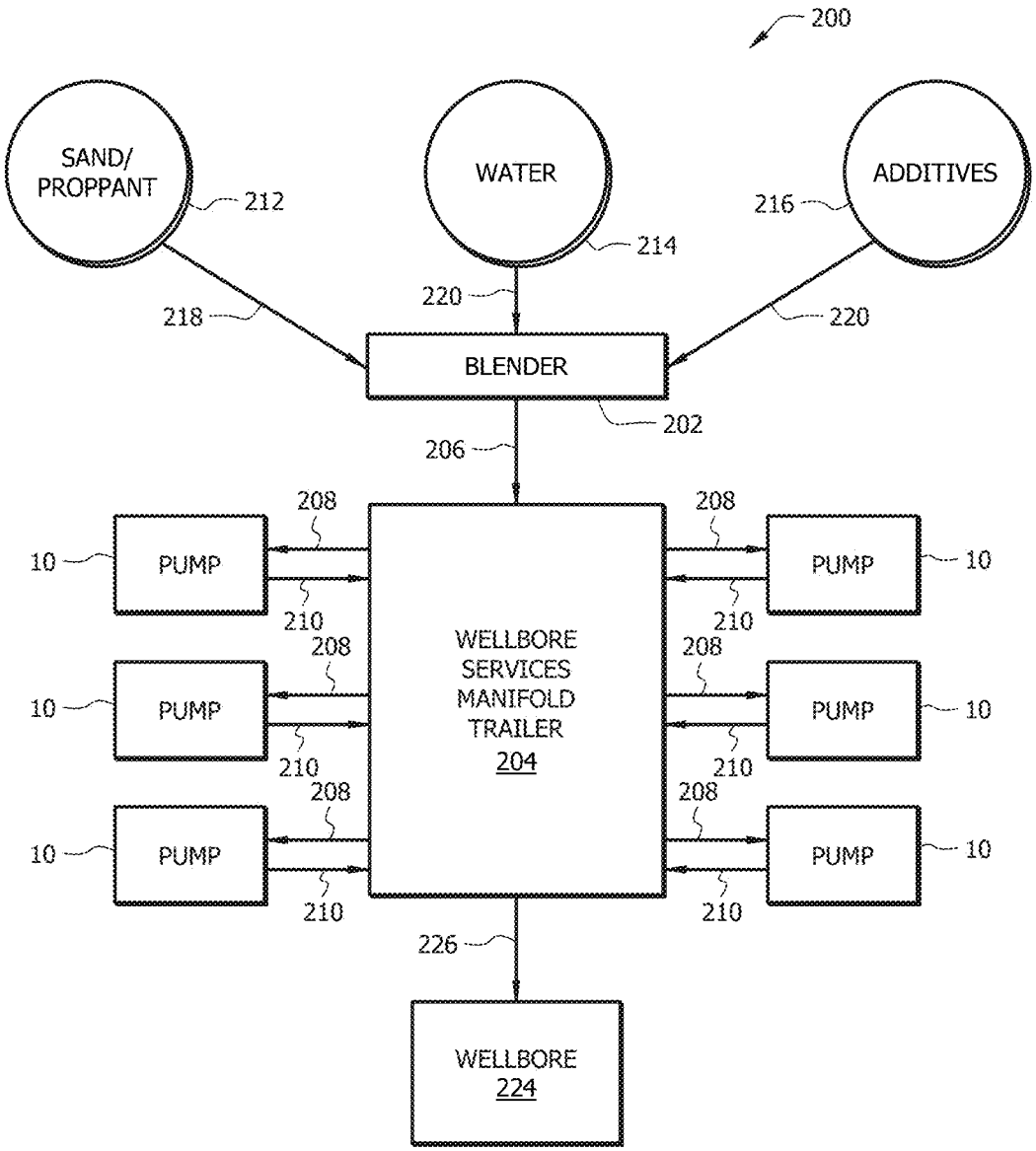
FIG. 9 is a schematic representation of an embodiment of a wellbore servicing system, according to embodiments of this disclosure.

Also disclosed herein are a method of servicing a wellbore and a wellbore servicing system 200 comprising a pump of this disclosure. An embodiment of a wellbore servicing system 200 and a method of servicing a wellbore via the wellbore servicing system 200 will now be described with reference to FIG. 9, which is a schematic representation of an embodiment of a wellbore servicing system 200, according to embodiments of this disclosure.

A method of servicing a wellbore 224 according to this disclosure comprises fluidly coupling a pump 10 of this disclosure to a source of a wellbore servicing fluid and to the wellbore, and communicating wellbore servicing fluid into the wellbore via the pump. The method can further comprise discontinuing the communicating of the wellbore servicing fluid into the wellbore via the pump, subjecting the pump to maintenance to provide a maintained pump, and communicating the or another wellbore servicing fluid into the wellbore via the maintained pump. Subjecting the pump to maintenance can comprise servicing the pump 10, as described hereinabove.

In embodiments, a method of servicing a wellbore 224 according to this disclosure comprises fluidly coupling pump 10 to a source of a wellbore servicing fluid and to the wellbore 224, and, on a suction stroke of the pump 10 in which the reciprocating element 18 and the fluid intake end 81 of the movable manifold 80 move in an axial direction 116 toward the pump power end 12 of the pump 10, flowing wellbore servicing fluid from the stationary fluid manifold 83, through the movable manifold 80, and into the pump fluid end 22 via the fluid intake end 62 of the hollow cylindrical reciprocating element 18, and, on a discharge stroke of the pump 10 in which the reciprocating element 18 and the fluid intake end 81 of the movable manifold 80 move in an axial direction 117 away from the pump power end 12 of the pump 10, discharging wellbore servicing fluid from the pump fluid end 22 via the discharge outlet 54 of the pump 10, whereby the discharged wellbore servicing fluid is introduced into the wellbore 224.

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, sealants, drilling fluids, completion fluids, gelation fluids, polymeric fluids, aqueous fluids, oleaginous fluids, etc.

In embodiments, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 10 (e.g., pump(s) 10 and/or maintained pump(s) 10) pressurize the wellbore servicing fluid to a pressure suitable for delivery into a wellbore 224 or wellhead. For example, the pumps 10 may increase the pressure of the wellbore servicing fluid (e.g., the wellbore servicing fluid and/or the another wellbore servicing fluid) to a pressure of greater than or equal to about 10,000 psi, 20,000 psi, 30,000 psi, 40,000 psi, or 50,000 psi, or higher.

From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. in embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. Persons of ordinary skill in the art with the aid of this disclosure will appreciate that the flowlines described herein are piping that are connected together for example via flanges, collars, welds, etc. These flowlines may include various configurations of pipe tees, elbows, and the like.

These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared onsite (e.g., via the operation of one or more blenders) or, alternatively, transported to the site of the servicing operation.

In embodiments, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In alternative embodiments, the reciprocating apparatus may comprise a compressor. In embodiments, a compressor similar to the pump 10 may comprise at least one each of a cylinder, plunger, connecting rod, crankshaft, and housing, and may be coupled to a motor. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. For instance, in embodiments, the herein disclosed pump fluid end 22 design comprising hollow reciprocating element 18 fluidly coupled with a movable manifold 80 as described herein can provide for a reduction in maintenance time, a reduction in fluid end 22 cost, an increase in fluid end 22 lifetime, a reduction in pump fluid end 22 weight, and/or a reduced reciprocating element packing 29 replacement time of at least 10, 20, 30, 40, or 50% relative to a pump fluid end not comprising such a movable manifold 80. A reduction in pump fluid end 22 maintenance and/or assembly time reduces exposure of workers performing the maintenance (and thus potentially enhances safety) and also reduces non-productive time on location. In embodiments, the herein disclosed design enables the use of a fluid end 22 which does not have a cross-bore that houses the suction valve of suction valve assembly 56 and discharge valve of discharge valve assembly 72. According to this disclosure, the suction and discharge valves can be arranged in a concentric manner in line, and the suction valve can be mounted on the moving reciprocating element 18.

Additional Disclosure

The following are non-limiting, specific embodiments in accordance with the present disclosure:

Embodiment A

A hose for a reciprocating pump, the hose comprising: a first end and a second end separated by a length (L) along a centerline of the hose, wherein the first end reciprocates with a reciprocating element of the reciprocating pump during operation of the reciprocating pump; an inner surface and an outer surface separated by a thickness; and a variable bend radius wherein a bend radius of a first section of the hose is different from a bend radius of at least one second section of the hose, such that, during operation of the reciprocating pump, a stress on the first end of the hose, the second end of the hose, or both the first end of the hose and the second end of the hose is reduced relative to that of a hose that does not contain the variable bend radius.

Embodiment B

The hose of Embodiment A, wherein the first section comprises a midpoint of the hose located a distance L/2 along the centerline from the first end and the second end of the hose.

Embodiment C

The hose of Embodiment A or Embodiment B, wherein the first bend radius is less than the second bend radius.

Embodiment D

The hose of any of Embodiment A to Embodiment C, wherein the at least one second section comprises a section of the hose located within 10, 15, 20, 25, or 30% of the length L of the hose from the first end of the hose, a section of the hose located within 10, 15, 20, 25, or 30% of the length L of the hose from the second end of the hose, or both a section of the hose located within 10, 15, 20, 25, or 30% of the length L of the hose from the first end of the hose and a section of the hose located within 10, 15, 20, 25, or 30% of the length L of the hose from the second end of the hose.

Embodiment E

The hose of any of Embodiment A to Embodiment D, wherein the inner surface of the hose defines an inside diameter (ID) of the hose, and wherein the ID of the hose is substantially constant along at least about 80, 90, or 100% of the length L of the hose.

Embodiment F

The hose of any of Embodiment A to Embodiment E, wherein the thickness of the first section of the hose is less than the thickness of the at least one second section of the hose.

Embodiment G

The hose of any of Embodiment A to Embodiment F, wherein a stiffness of the at least one second section of the hose is greater than a stiffness of the first section of the hose, wherein the stiffness is determined as the amount of force required to bend the flexible hose around a desired radius.

Embodiment H

The hose of Embodiment G, wherein the first section of the hose comprises a midpoint of the hose located a distance L/2 along the centerline from the first end and the second end of the hose, and wherein the at least one second section comprises a section of the hose located within 10, 15, 20, 25, or 30% of the length L of the hose from the first end of the hose, a section of the hose located within 10, 15, 20, 25, or 30% of the length L of the hose from the second end of the hose, or both a section of the hose located within 10, 15, 20, 25, or 30% of the length L of the hose from the first end of the hose and a section of the hose located within 10, 15, 20, 25, or 30% of the length L of the hose from the second end of the hose.

Embodiment I

The hose of any of Embodiment A to Embodiment H, wherein the at least one second section includes a section of the hose comprising a material that is different from a material of the first section of the hose and/or comprises a greater amount of the material of the first section of the hose than an amount of the material of the first section of the hose in the first section of the hose.

Embodiment J

The hose of Embodiment I, wherein the first section of the hose comprises a midpoint of the hose located a distance L/2 along the centerline from the first end and the second end of the hose, and wherein the at least one second section comprises a section of the hose located within 10, 15, 20, 25, or 30% of the length L of the hose from the first end of the hose, a section of the hose located within 10, 15, 20, 25, or 30% of the length L of the hose from the second end of the hose, or both a section of the hose located within 10, 15, 20, 25, or 30% of the length L of the hose from the first end of the hose and a section of the hose located within 10, 15, 20, 25, or 30% of the length L of the hose from the second end of the hose.

Embodiment K

The hose of Embodiment I or Embodiment J, wherein the at least one second section of the hose includes a section of the hose comprising an additional support material relative to the first section of the hose.

Embodiment L

The hose of Embodiment K, wherein the first section of the hose comprises a midpoint of the hose located a distance L/2 along the centerline from the first end and the second end of the hose, and wherein the at least one second section comprises a section of the hose located within 10, 15, 20, 25, or 30% of the length L of the hose from the first end of the hose, a section of the hose located within 10, 15, 20, 25, or 30% of the length L of the hose from the second end of the hose, or both a section of the hose located within 10, 15, 20, 25, or 30% of the length L of the hose from the first end of the hose and a section of the hose located within 10, 15, 20, 25, or 30% of the length L of the hose from the second end of the hose.

Embodiment M

The hose of Embodiment K or Embodiment L, wherein the inner surface, the outer surface, or both the inner surface and the outer surface of the hose comprises the additional support material.

Embodiment N

The hose of any of Embodiment I to Embodiment M, wherein the first section of the hose comprises a polymer, and wherein the at least one second section of the hose comprises the polymer comprising at least one additional additive.

Embodiment O

The hose of Embodiment N, wherein the at least one additional additive comprises a wire, a fiber, a mesh, or a combination thereof.

Embodiment P

The hose of any of Embodiment A to Embodiment O, wherein the hose is preformed such that, at rest, the hose assumes a configuration in which the hose comprises the variable bend radius wherein the bend radius of the first section of the hose is different from the bend radius of the at least one second section of the hose.

Embodiment Q

The hose of Embodiment P, wherein the configuration comprises a mid-stroke configuration the hose takes during operation of the reciprocating pump when a reciprocating element of the reciprocating pump is at a midpoint of a stroke of a pump power end of the reciprocating pump, such that the hose is in a substantially unstressed (e.g., neutral) position each time the pump is at the midpoint of a stroke, wherein the midpoint of the stroke is halfway between a fully extended position and a fully retracted position of the reciprocating element.

Embodiment R

The hose of Embodiment Q, wherein, in the mid-stroke configuration, the first section has a bend radius in a range of from ¼ to four times a stroke length of the reciprocating pump, wherein the stroke length is a distance traveled by a reciprocating element of the reciprocating pump from top dead center (TDC) to bottom dead center (BDC).

Embodiment S

The hose of Embodiment R, wherein, in the mid-stroke configuration, each at least one second section has a radius of curvature that transitions along a length thereof from the bend radius of the first section in the mid-stroke configuration to an infinite bend radius.

Embodiment T

The hose of any of Embodiment A to Embodiment S, wherein the first end of the hose, the second end of the hose, or both the first end of the hose and the second end of the hose comprises a rigid metal connection.

Embodiment U

A pump comprising: a bore pump fluid end having a reciprocating element bore; a reciprocating element having a front end opposite a fluid intake end and comprising a peripheral wall defining a hollow body; a hose comprising a first end and a second end separated by a length L along a centerline of the hose, an inner surface and an outer surface separated by a thickness, and a first section of the hose having a bend radius that is different from a bend radius of at least one second section of the hose, wherein the first end of the hose is fluidly connected with the fluid intake end of the reciprocating element, whereby the first end of the hose moves in a same axial direction as the reciprocating element during reciprocation of the reciprocating element in alternating directions along a path within the reciprocating element bore of the bore pump fluid end, and wherein the second end of the hose is configured for fluid coupling with a stationary fluid manifold such that fluid can be introduced into the hose via the stationary fluid manifold and the second end of the hose; and a power end operatively connected to the reciprocating element and operable to reciprocate the reciprocating element in the reciprocating element bore of the bore pump fluid end.

Embodiment V

The pump of Embodiment U, wherein the pump is a high-pressure pump configured to operate at a pressure greater than or equal to about 3,000, 10,000, 20,000, 30,000, 40,000, or 50,000 psi and/or in a well servicing operation and environment.

Embodiment W

The pump of Embodiment U or Embodiment V, wherein the pump comprises a reciprocating element packing within the bore pump fluid end, wherein the reciprocating element packing seals a space between a wall of the reciprocating element bore and an outside of the peripheral wall of the reciprocating element, providing a high pressure chamber extending in an axial direction toward the front end of the reciprocating element from the reciprocating element packing, and wherein, during operation of the pump, an outside of the peripheral wall of a portion of the reciprocating element outside the high pressure chamber does not contact a fluid being pumped by the pump.

Embodiment X

The pump of any of Embodiment U to Embodiment W further comprising a suction valve assembly located at least partially within the front end of the reciprocating element and a discharge valve assembly located at an end of the reciprocating element bore distal the power end, and wherein the pump is a multiplex pump comprising a plurality of reciprocating elements, and a corresponding plurality of reciprocating element bores, suction valve assemblies, discharge valve assemblies, and hoses.

Embodiment Y

A method of servicing the bore pump of any of Embodiment U to Embodiment X, the method comprising: accessing a reciprocating element packing associated with the reciprocating element and located within the pump fluid end, wherein the reciprocating element packing seals a space between a wall of the reciprocating element bore and an outside of the peripheral wall of the reciprocating element, providing a high pressure chamber extending in an axial direction toward the front end of the reciprocating element from the reciprocating element packing, and wherein, during operation of the pump, an outside of the peripheral wall of a portion of the reciprocating element outside the high pressure chamber does not contact a fluid being pumped by the pump.

Embodiment Z1

A method of servicing a wellbore, the method comprising: fluidly coupling a pump to a source of a wellbore servicing fluid and to the wellbore, wherein the pump comprises: a pump fluid end comprising a reciprocating element bore; a reciprocatable reciprocating element having a front end opposite a fluid intake end and comprising a peripheral wall defining a hollow body; a hose comprising a first end and a second end separated by a length L along a centerline of the hose, an inner surface and an outer surface separated by a thickness, and a first section of the hose having a bend radius that is different from a bend radius of at least one second section of the hose, wherein the first end of the hose is fluidly connected with the fluid intake end of the reciprocating element, whereby the first end of the hose moves in a same axial direction as the reciprocating element during reciprocation of the reciprocating element in alternating directions along a path within the reciprocating element bore of the pump fluid end, and wherein the second end of the hose is configured for fluid coupling with a stationary fluid manifold such that fluid can be introduced into the hose via the stationary fluid manifold and the second end of the hose; and a power end operatively connected to the reciprocating element and operable to reciprocate the reciprocating element in the reciprocating element bore of the pump fluid end; and communicating wellbore servicing fluid into the wellbore via the pump.

Embodiment Z2

The method of Embodiment Z1 further comprising: discontinuing the communicating of the wellbore servicing fluid into the wellbore via the pump; and subjecting the pump to maintenance to provide a maintained pump, wherein subjecting the pump to maintenance comprises accessing a reciprocating element packing associated with the reciprocating element and located within the pump fluid end, wherein the reciprocating element packing seals a space between a wall of the reciprocating element bore and an outside of the peripheral wall of the reciprocating element, providing a high pressure chamber extending in an axial direction toward the front end of the reciprocating element from the reciprocating element packing, such that, during operation of the pump, an outside of the peripheral wall of a portion of the reciprocating element outside the high pressure chamber does not contact a fluid being pumped by the pump, and wherein accessing the reciprocating element packing does not require disconnecting the hose from the reciprocating pump; and communicating the or another wellbore servicing fluid into the wellbore via the maintained pump.

Embodiment Z3

The method of Embodiment Z2, wherein the pump comprises an integration section located in a space between the pump fluid end and the power end, wherein the hose is located in the integration section, and wherein accessing the reciprocating element packing comprises accessing the reciprocating element packing via the integration section.

Embodiment Z4

The method of Embodiment Z2 or Embodiment Z3, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

Embodiment Z5

The method of any of Embodiment Z2 to Embodiment Z4, wherein the pump or the maintained pump operates during the pumping of the wellbore servicing fluid or the another wellbore servicing fluid at a pressure of greater than or equal to about 3,000 psi, 5,000 psi, 10,000 psi, 20,000 psi, 30,000 psi, 40,000 psi, or 50,000 psi.

Embodiment Z6

The method of any of Embodiment Z2 to Embodiment Z5, wherein the pump or the maintained pump operates during the pumping of the wellbore servicing fluid or the another wellbore servicing fluid at a volumetric flow rate of flow rate of greater than or equal to about 3, 10, 20, 30, 40, or 50 barrels per minute (BPM), or in a range of from about 3 to about 50, 3 to about 30, from about 3 to about 20, from about 10 to about 20, or from about 5 to about 20 BPM.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A hose for a reciprocating pump, the hose comprising:

a first end and a second end separated by a length (L) along a centerline of the hose, wherein the first end reciprocates with a reciprocating element of the reciprocating pump during operation of the reciprocating pump;

an inner surface and an outer surface separated by a thickness; and a variable bend radius wherein a bend radius of a first section of the hose is different from a bend radius of at least one second section of the hose, such that, during operation of the reciprocating pump, a stress on the first end of the hose, the second end of the hose, or both the first end of the hose and the second end of the hose is reduced relative to that of a hose that does not contain the variable bend radius, wherein the hose is preformed such that, at rest, the hose assumes a configuration in which the hose comprises the variable bend radius, wherein the configuration comprises a mid-stroke configuration the hose takes during operation of the reciprocating pump when a reciprocating element of the reciprocating pump is at a midpoint of a stroke of a pump power end of the reciprocating pump, such that the hose is in a substantially unstressed position each time the pump is at the midpoint of a stroke, wherein the midpoint of the stroke is halfway between a fully extended position and a fully retracted position of the reciprocating element, and wherein, in the mid-stroke configuration:

the first section has a bend radius in a range of from ¼ to four times a stroke length of the reciprocating pump, wherein the stroke length is a distance traveled by the reciprocating element of the reciprocating pump from top dead center (TDC) to bottom dead center (BDC); and/or each at least one second section has a radius of curvature that transitions along a length thereof from the bend radius of the first section in the mid-stroke configuration to an infinite bend radius.

2. The hose of claim 1, wherein the first section comprises a midpoint of the hose located a distance L/2 along the centerline from the first end and the second end of the hose.

3. The hose of claim 2, wherein the first bend radius is less than the second bend radius.

4. The hose of claim 2, wherein the at least one second section comprises a section of the hose located within 30% of the length L of the hose from the first end of the hose, a section of the hose located within 30% of the length L of the hose from the second end of the hose, or both a section of the hose located within 30% of the length L of the hose from the first end of the hose and a section of the hose located within 30% of the length L of the hose from the second end of the hose.

5. The hose of claim 1, wherein the thickness of the first section of the hose is less than the thickness of the at least one second section of the hose.

6. The hose of claim 1, wherein a stiffness of the at least one second section of the hose is greater than a stiffness of the first section of the hose, wherein the stiffness is determined as the amount of force required to bend the flexible hose around a desired radius.

7. The hose of claim 6, wherein the first section of the hose comprises a midpoint of the hose located a distance L/2 along the centerline from the first end and the second end of the hose, and wherein the at least one second section comprises a section of the hose located within 30% of the length L of the hose from the first end of the hose, a section of the hose located within 30% of the length L of the hose from the second end of the hose, or both a section of the hose located within 30% of the length L of the hose from the first end of the hose and a section of the hose located within 30% of the length L of the hose from the second end of the hose.

8. The hose of claim 1, wherein the at least one second section includes a section of the hose comprising a material that is different from a material of the first section of the hose and/or comprises a greater amount of the material of the first section of the hose than an amount of the material of the first section of the hose in the first section of the hose.

9. The hose of claim 8, wherein the first section of the hose comprises a midpoint of the hose located a distance L/2 along the centerline from the first end and the second end of the hose, and wherein the at least one second section comprises a section of the hose located within 30% of the length L of the hose from the first end of the hose, a section of the hose located within 30% of the length L of the hose from the second end of the hose, or both a section of the hose located within 30% of the length L of the hose from the first end of the hose and a section of the hose located within 30% of the length L of the hose from the second end of the hose.

10. The hose of claim 8, wherein the at least one second section of the hose includes a section of the hose comprising an additional support material relative to the first section of the hose.

11. The hose of claim 10, wherein the first section of the hose comprises a midpoint of the hose located a distance L/2 along the centerline from the first end and the second end of the hose, and wherein the at least one second section comprises a section of the hose located within 30% of the length L of the hose from the first end of the hose, a section of the hose located within 30% of the length L of the hose from the second end of the hose, or both a section of the hose located within 30% of the length L of the hose from the first end of the hose and a section of the hose located within 30% of the length L of the hose from the second end of the hose.

12. The hose of claim 10, wherein the inner surface, the outer surface, or both the inner surface and the outer surface of the hose comprises the additional support material.

13. The hose of claim 8, wherein the first section of the hose comprises a polymer, and wherein the at least one second section of the hose comprises the polymer comprising at least one additional additive.

14. The hose of claim 13, wherein the at least one additional additive comprises a wire, a fiber, a mesh, or a combination thereof.

15. A reciprocating pump comprising the hose of claim 1.

16. A method of servicing a wellbore, the method comprising:

fluidly coupling the pump of claim 15 to a source of a wellbore servicing fluid and to the wellbore; and communicating wellbore servicing fluid into the wellbore via the pump.

17. A pump comprising:

a bore pump fluid end having a reciprocating element bore;

a reciprocating element having a front end opposite a fluid intake end and comprising a peripheral wall defining a hollow body;

a hose comprising a first end and a second end separated by a length L along a centerline of the hose, an inner surface and an outer surface separated by a thickness, and a variable bend radius wherein a bend radius of a first section of the hose is different from a bend radius of at least one second section of the hose, wherein the first end of the hose is fluidly connected with the fluid intake end of the reciprocating element, whereby the first end of the hose moves in a same axial direction as the reciprocating element during reciprocation of the reciprocating element in alternating directions along a path within the reciprocating element bore of the bore pump fluid end, and wherein the second end of the hose is configured for fluid coupling with a stationary fluid manifold such that fluid can be introduced into the hose via the stationary fluid manifold and the second end of the hose; and a power end operatively connected to the reciprocating element and operable to reciprocate the reciprocating element in the reciprocating element bore of the bore pump fluid end, wherein during operation of the pump, a stress on the first end of the hose, the second end of the hose, or both the first end of the hose and the second end of the hose is reduced relative to that of a hose that does not contain the variable bend radius, wherein the hose is preformed such that, at rest, the hose assumes a configuration in which the hose comprises the variable bend radius, wherein the configuration comprises a mid-stroke configuration the hose takes during operation of the pump when the reciprocating element of the pump is at a midpoint of a stroke of the pump power end of the pump, such that the hose is in a substantially unstressed position each time the pump is at the midpoint of a stroke, wherein the midpoint of the stroke is halfway between a fully extended position and a fully retracted position of the reciprocating element, and wherein, in the mid-stroke configuration:

the first section has a bend radius in a range of from ¼ to four times a stroke length of the pump, wherein the stroke length is a distance traveled by the reciprocating element of the pump from top dead center (TDC) to bottom dead center (BDC); and/or each at least one second section has a radius of curvature that transitions along a length thereof from the bend radius of the first section in the mid-stroke configuration to an infinite bend radius.

18. The pump of claim 17, wherein the pump is a high-pressure pump configured to operate at a pressure greater than or equal to about 3,000 psi and/or in a well servicing operation and environment.

19. The pump of claim 17, wherein the thickness of the first section of the hose is less than the thickness of the at least one second section of the hose.

20. A method of servicing a wellbore, the method comprising:

fluidly coupling a pump to a source of a wellbore servicing fluid and to the wellbore, wherein the pump comprises:

a pump fluid end comprising a reciprocating element bore;

a reciprocatable reciprocating element having a front end opposite a fluid intake end and comprising a peripheral wall defining a hollow body;

a hose comprising a first end and a second end separated by a length L along a centerline of the hose, an inner surface and an outer surface separated by a thickness, and a variable bend radius wherein a bend radius of a first section of the hose is different from a bend radius of at least one second section of the hose, wherein the first end of the hose is fluidly connected with the fluid intake end of the reciprocating element, whereby the first end of the hose moves in a same axial direction as the reciprocating element during reciprocation of the reciprocating element in alternating directions along a path within the reciprocating element bore of the pump fluid end, and wherein the second end of the hose is configured for fluid coupling with a stationary fluid manifold such that fluid can be introduced into the hose via the stationary fluid manifold and the second end of the hose; and a power end operatively connected to the reciprocating element and operable to reciprocate the reciprocating element in the reciprocating element bore of the pump fluid end; and communicating wellbore servicing fluid into the wellbore via the pump, wherein during operation of the pump, a stress on the first end of the hose, the second end of the hose, or both the first end of the hose and the second end of the hose is reduced relative to that of a hose that does not contain the variable bend radius, wherein the hose is preformed such that, at rest, the hose assumes a configuration in which the hose comprises the variable bend radius, wherein the configuration comprises a mid-stroke configuration the hose takes during operation of the pump when the reciprocating element of the pump is at a midpoint of a stroke of the pump power end of the pump, such that the hose is in a substantially unstressed position each time the pump is at the midpoint of a stroke, wherein the midpoint of the stroke is halfway between a fully extended position and a fully retracted position of the reciprocating element, and wherein, in the mid-stroke configuration:

the first section has a bend radius in a range of from ¼ to four times a stroke length of the pump, wherein the stroke length is a distance traveled by the reciprocating element of the pump from top dead center (TDC) to bottom dead center (BDC); and/or each at least one second section has a radius of curvature that transitions along a length thereof from the bend radius of the first section in the mid-stroke configuration to an infinite bend radius.

* * * * *